US010100501B2

(12) United States Patent
Figurski et al.

(10) Patent No.: US 10,100,501 B2
(45) Date of Patent: Oct. 16, 2018

(54) MULTI-PURPOSE HAND WASHING STATION

(71) Applicant: Bradley Fixtures Corporation, Menomonee Falls, WI (US)

(72) Inventors: Mark A. Figurski, Hartland, WI (US); Michelle L. Rundberg, Jackson, WI (US); John M. Loberger, Germantown, WI (US); Terry Lee McCallum, Milwaukee, WI (US); Dale William Gallmann, Menomonee Falls, WI (US); Jason M. Renner, Greenfield, WI (US); Jeffery S. Jaworski, Sussex, WI (US); Theodore E. Dhein, Sussex, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 481 days.

(21) Appl. No.: 14/423,642

(22) PCT Filed: Mar. 13, 2013

(86) PCT No.: PCT/US2013/031162

§ 371 (c)(1),
(2) Date: Feb. 24, 2015

(87) PCT Pub. No.: WO2014/031159

PCT Pub. Date: Feb. 27, 2014

(65) Prior Publication Data

US 2015/0225932 A1 Aug. 13, 2015

Related U.S. Application Data

(60) Provisional application No. 61/692,982, filed on Aug. 24, 2012.

(51) Int. Cl.

| | |
|---|---|
| ***E03C 1/04*** | (2006.01) |
| ***A47K 5/12*** | (2006.01) |
| ***A47K 10/48*** | (2006.01) |

(52) U.S. Cl.

CPC ..... *E03C 1/04* (2013.01); *A47K 5/12* (2013.01); *A47K 5/1211* (2013.01); *A47K 10/48* (2013.01);

(Continued)

(58) Field of Classification Search

CPC . E03C 1/04; E03C 1/044; E03C 1/046; A47K 5/12; A47K 5/1211; A47K 10/48

(Continued)

(56) References Cited

U.S. PATENT DOCUMENTS

| | | | |
|---|---|---|---|
| 540,235 | A | 6/1895 | Clifford et al. |
| D30,136 | S | 2/1899 | Eckerson |

(Continued)

FOREIGN PATENT DOCUMENTS

| | | |
|---|---|---|
| AT | 141398 | 8/1996 |
| AU | 2005203363 | 2/2006 |

(Continued)

*Primary Examiner* — Tuan N Nguyen

(74) *Attorney, Agent, or Firm* — Boyle Fredrickson, S.C.

(57) ABSTRACT

A multi-purpose hand washing station is disclosed that includes a hand dryer attached to a basin. The hand dryer includes a top air plenum and a bottom air plenum. A grid molded into each air plenum provides structural support to the plenums. Both the top and bottom air plenums include a plurality of air outlets that direct pressurized air from a blower for hand drying. An air hose that supplies pressurized air to the bottom air plenum includes a water trap that prevents water from flowing into the air outlets, down the air hose, and to the blower. A soap dispenser mounted on the basin dispenses liquefied soap for hand washing and is refillable by opening a lid on the soap dispenser and pouring (Continued)

liquefied soap into a funnel insert where it travels through a fill port into a reservoir.

12 Claims, 21 Drawing Sheets

(52) U.S. Cl.
CPC .. *A47K 2005/1218* (2013.01); *A47K 2210/00* (2013.01)

(58) Field of Classification Search
USPC ..... 4/619, 623, 628, 638
See application file for complete search history.

(56) References Cited

U.S. PATENT DOCUMENTS

D36,574 S 2/1899 Zipp
D36,575 S 10/1903 Zipp
D36,595 S 10/1903 Peet
937,509 A 10/1909 Carpenter
1,069,972 A 8/1913 Metzaer
1,323,398 A 12/1919 Leland
1,419,712 A 6/1922 Bassette
1,423,800 A 7/1922 Hibbard et al.
1,494,883 A 5/1924 Bassette et al.
1,578,047 A 3/1926 Lum
1,579,705 A 4/1926 Hewitt
1,616,313 A 2/1927 Farmer
1,659,851 A 2/1928 Brewington
1,750,094 A 3/1930 Emmrich
1,765,915 A 6/1930 Haase
D81,754 S 8/1930 Mabee
1,816,055 A 7/1931 Pfeifer
1,961,179 A 6/1934 Tinkham
1,997,387 A 4/1935 McCord
2,003,183 A 7/1935 McCord
2,027,605 A 5/1936 McCord et al.
2,041,352 A 5/1936 Jordan
D100,310 S 7/1936 Blu
2,130,196 A 9/1938 Sakier
2,192,383 A 3/1940 Krolop
2,202,107 A 5/1940 Korn
2,281,370 A 4/1942 Morrison et al.
2,328,129 A 8/1943 Earle
2,438,762 A 3/1948 McLeckie
2,470,187 A 5/1949 Price
2,479,571 A 8/1949 Hewitt
2,498,699 A 2/1950 Mullett et al.
2,504,740 A 4/1950 Siegel
2,521,769 A 9/1950 Arcularius
2,537,821 A 1/1951 Fodor
2,591,669 A 4/1952 Bucknell et al.
2,606,274 A 8/1952 Spierer
RE23,674 E 6/1953 Spierer et al.
2,641,679 A 6/1953 Brodbeck
2,646,629 A 7/1953 Clemens
D170,204 S 8/1953 Long
2,651,705 A 9/1953 Clemens
2,666,837 A 1/1954 Brodbeck
2,677,041 A 4/1954 Oliver et al.
2,698,894 A 1/1955 Stein
2,714,151 A 7/1955 Becker
2,761,222 A 9/1956 Bennett
2,767,407 A 10/1956 Weiss
2,777,934 A 1/1957 Falkenthal
2,826,763 A 3/1958 Bass
2,837,835 A 6/1958 Hewitt et al.
2,853,591 A 9/1958 Fine
2,853,592 A 9/1958 Gravet
2,859,535 A 11/1958 Carlson
2,906,627 A 9/1959 Payton et al.
2,908,019 A 10/1959 Lyon, Jr.
2,965,906 A 12/1960 Mullett et al.
2,977,455 A 3/1961 Murphy
3,059,815 A 10/1962 Parsons, Jr.
3,065,473 A 11/1962 Sporck et al.
3,076,887 A 2/1963 Bulow
3,128,161 A 4/1964 Hudon
D201,493 S 6/1965 Sundberg et al.
3,220,424 A 11/1965 Nelson
3,305,938 A 2/1967 Arthur
D210,131 S 2/1968 Rourke
3,384,977 A 5/1968 Rosenberg
3,409,995 A 11/1968 Greenwood et al.
3,415,278 A 12/1968 Yamamoto et al.
3,449,838 A 6/1969 Chancellor
3,480,787 A 11/1969 Johansen
3,487,477 A 1/1970 Classen
3,491,381 A 1/1970 Catheart
3,502,384 A 3/1970 Gipson
3,505,692 A 4/1970 Forbes
3,523,305 A 8/1970 Zorn
3,536,294 A 10/1970 Rodriguez
3,551,919 A 1/1971 Forbes
3,556,158 A 1/1971 Schneider
3,575,583 A 4/1971 Brown
3,575,640 A 4/1971 Ichikawa
3,576,277 A 4/1971 Blackmon
3,585,652 A 6/1971 Forbes et al.
3,585,653 A 6/1971 Forbes et al.
3,587,177 A 6/1971 Overly et al.
3,588,038 A 6/1971 Tanaka
3,603,002 A 9/1971 Spierer
3,613,124 A 10/1971 Ichimori et al.
3,621,199 A 11/1971 Goldstein
3,639,920 A 2/1972 Griffin et al.
13,643,346 2/1972 Lester
3,699,984 A 10/1972 Davis
3,724,001 A 4/1973 Ichimori et al.
3,744,149 A 7/1973 Heibling
3,746,035 A 7/1973 Singer
3,757,806 A 9/1973 Bhaskar et al.
3,817,651 A 6/1974 Law et al.
3,878,621 A 4/1975 Duerre
3,904,167 A 9/1975 Touch et al.
3,918,987 A 11/1975 Kopter
D238,075 S 12/1975 Harris
3,975,781 A 8/1976 Klimboff et al.
3,992,730 A 11/1976 Davis
4,072,157 A 2/1978 Wines, Jr. et al.
4,120,180 A 10/1978 Jedora
4,144,596 A 3/1979 MacFarlane et al.
4,145,602 A 3/1979 Lee
4,145,769 A 3/1979 MacFarlane et al.
D251,795 S 5/1979 McCann
4,193,209 A 3/1980 Lovison et al.
4,195,416 A 4/1980 Hall
4,219,367 A 8/1980 Cary, Jr. et al.
4,239,555 A 12/1980 Scharlack et al.
4,256,133 A 3/1981 Coward et al.
D260,878 S 9/1981 Hiller
4,295,233 A 10/1981 Hinkel et al.
4,309,781 A 1/1982 Lissau
4,336,619 A 6/1982 Hinkel et al.
4,375,874 A 3/1983 Leotta et al.
4,383,377 A 5/1983 Crafton
4,398,310 A 8/1983 Lienhard
4,402,095 A 9/1983 Pepper
4,402,331 A 9/1983 Taldo et al.
D272,263 S 1/1984 Lienhard
4,429,422 A 2/1984 Warcham
4,453,286 A 6/1984 Weiland
4,461,439 A 7/1984 Rose
4,497,999 A 2/1985 Postbeschild
4,509,543 A 4/1985 Livingston et al.
D279,404 S 6/1985 Hiller
4,520,516 A 6/1985 Parsons
4,541,563 A 9/1985 Uetsuhara
4,570,823 A 2/1986 Arabian et al.
4,594,797 A 6/1986 Houck, Jr.
4,598,726 A 7/1986 Pepper
4,604,764 A 8/1986 Enzo
4,606,085 A 8/1986 Davies

(56) References Cited

U.S. PATENT DOCUMENTS

| | | | |
|---|---|---|---|
| 4,610,165 | A | 9/1986 | Duffy et al. |
| 4,611,768 | A | 9/1986 | Voss et al. |
| 4,624,017 | A | 11/1986 | Foletta |
| 4,637,254 | A | 1/1987 | Dyben et al. |
| 4,642,821 | A | 2/1987 | Zanuso et al. |
| 4,642,909 | A | 2/1987 | Garcial |
| 4,644,256 | A | 2/1987 | Farias et al. |
| 4,651,777 | A | 3/1987 | Hardman |
| 4,653,201 | A | 3/1987 | Seaman |
| 4,671,121 | A | 6/1987 | Schieler |
| 14,670,010 | | 6/1987 | Dragone |
| 4,681,141 | A | 7/1987 | Wang |
| 4,682,628 | A | 7/1987 | Hill |
| 4,685,222 | A | 8/1987 | Houck, Jr. |
| 4,688,277 | A | 8/1987 | Kakinoki |
| 4,688,585 | A | 8/1987 | Vetter |
| 4,700,049 | A | 10/1987 | Rubin |
| 4,702,107 | A | 10/1987 | Guerrini et al. |
| 4,707,867 | A | 11/1987 | Kawabe et al. |
| 4,707,933 | A | 11/1987 | Keck et al. |
| 14,709,728 | | 12/1987 | Ying-Chung |
| 4,716,605 | A | 1/1988 | Shepherd et al. |
| 4,722,372 | A | 2/1988 | Hoffman et al. |
| 4,735,002 | A | 4/1988 | Rath |
| 4,735,357 | A | 4/1988 | Gregory et al. |
| 4,741,363 | A | 5/1988 | Hu |
| 4,742,583 | A | 5/1988 | Yoshida et al. |
| 4,742,836 | A | 5/1988 | Buehler |
| 4,744,515 | A | 5/1988 | Watanabe |
| 4,746,090 | A | 5/1988 | Hamilton |
| 4,762,273 | A | 8/1988 | Gregory et al. |
| 4,765,003 | A | 8/1988 | Chang |
| 4,767,922 | A | 8/1988 | Stauffer |
| 4,769,863 | A | 9/1988 | Tegg et al. |
| 4,780,595 | A | 10/1988 | Alban |
| 4,785,162 | A | 11/1988 | Kuo |
| 4,823,414 | A | 4/1989 | Piersimoni et al. |
| 4,826,129 | A | 5/1989 | Fong et al. |
| 4,839,039 | A | 6/1989 | Parsons et al. |
| 4,848,599 | A | 7/1989 | Kano et al. |
| 4,852,802 | A | 8/1989 | Iggulden et al. |
| 4,856,122 | A | 8/1989 | Pilolla |
| 4,857,112 | A | 8/1989 | Franninge |
| 4,857,705 | A | 8/1989 | Blevins |
| 4,872,485 | A | 10/1989 | Laverty, Jr. |
| 4,876,435 | A | 10/1989 | Hawkins |
| 4,882,467 | A | 11/1989 | Dimick |
| 4,883,749 | A | 11/1989 | Roberts et al. |
| 4,889,315 | A | 12/1989 | Imanaga |
| 4,894,874 | A | 1/1990 | Wilson |
| 4,909,580 | A | 3/1990 | Mitchell |
| 4,914,758 | A | 4/1990 | Shaw |
| 4,914,833 | A | 4/1990 | Pilolla et al. |
| 4,916,347 | A | 4/1990 | Iqbal et al. |
| 4,916,613 | A | 4/1990 | Kent |
| 4,921,129 | A | 5/1990 | Jones et al. |
| 4,921,131 | A | 5/1990 | Binderbauer et al. |
| 4,921,211 | A | 5/1990 | Novak et al. |
| 4,940,298 | A | 7/1990 | Jackson et al. |
| 4,941,219 | A | 7/1990 | Van Marcke |
| 4,942,631 | A | 7/1990 | Rosa |
| 4,948,090 | A | 8/1990 | Chen |
| 4,953,236 | A | 9/1990 | Lee et al. |
| 4,954,179 | A | 9/1990 | Franninge |
| 4,956,535 | A | 9/1990 | Tautsui et al. |
| 4,959,603 | A | 9/1990 | Yamamoto et al. |
| 4,963,780 | A | 10/1990 | Hochstrasser |
| 4,967,425 | A | 11/1990 | Kawamura et al. |
| 4,971,106 | A | 11/1990 | Tsutsui et al. |
| 4,980,474 | A | 12/1990 | Hayasjo et al. |
| 4,980,574 | A | 12/1990 | Cirrito |
| 4,984,314 | A | 1/1991 | Weigert |
| 4,986,221 | A | 1/1991 | Shaw |
| 4,989,755 | A | 2/1991 | Shiau |
| 4,995,585 | A | 2/1991 | Gruber et al. |
| 4,998,673 | A | 3/1991 | Pilolla |
| 5,000,044 | A | 3/1991 | Duffy et al. |
| 5,008,963 | A | 4/1991 | Stein |
| 5,018,550 | A | 5/1991 | Burdorff |
| 5,025,516 | A | 6/1991 | Wilson |
| 5,031,258 | A | 7/1991 | Shaw |
| 5,031,337 | A | 7/1991 | Piloila et al. |
| 5,033,508 | A | 7/1991 | Laverty, Jr. |
| 5,033,715 | A | 7/1991 | Chiang et al. |
| 5,060,323 | A | 10/1991 | Shaw |
| 5,062,164 | A | 11/1991 | Lee et al. |
| 5,063,622 | A | 11/1991 | Tsutsui et al. |
| 5,063,956 | A | 11/1991 | Sakakibara |
| 5,072,618 | A | 12/1991 | Taylor et al. |
| 5,074,322 | A | 12/1991 | Jaw |
| 5,074,520 | A | 12/1991 | Lee et al. |
| 5,076,424 | A | 12/1991 | Nakamura |
| 5,080,324 | A | 1/1992 | Chi |
| RE33,810 | E | 2/1992 | Streiter |
| 5,084,984 | A | 2/1992 | Duchaud et al. |
| 5,086,526 | A | 2/1992 | Van Marcke |
| 5,092,560 | A | 3/1992 | Chen |
| 5,095,941 | A | 3/1992 | Betz |
| 5,099,587 | A | 3/1992 | Jarosch |
| 5,111,594 | A | 5/1992 | Allen |
| D326,711 | S | 6/1992 | Lotito et al. |
| 5,117,693 | A | 6/1992 | Duksa |
| 5,133,095 | A | 7/1992 | Shiba et al. |
| 5,144,757 | A | 9/1992 | Sasso |
| 5,146,695 | A | 9/1992 | Yang |
| 5,158,114 | A | 10/1992 | Botsolas |
| 5,163,234 | A | 11/1992 | Tsukamoto et al. |
| 5,169,118 | A | 12/1992 | Whiteside |
| 5,170,044 | A | 12/1992 | Shirai |
| D332,194 | S | 1/1993 | Hines |
| D332,195 | S | 1/1993 | Hines |
| D332,196 | S | 1/1993 | Hines |
| D332,365 | S | 1/1993 | Hines |
| D332,366 | S | 1/1993 | Hines |
| D332,369 | S | 1/1993 | Hanna et al. |
| D332,370 | S | 1/1993 | Hanna et al. |
| D332,542 | S | 1/1993 | Hines |
| D332,679 | S | 1/1993 | Hines |
| D332,849 | S | 1/1993 | Hines |
| 5,175,892 | A | 1/1993 | Shaw |
| 5,177,879 | A | 1/1993 | Muta |
| 5,181,328 | A | 1/1993 | Bouverie |
| D332,889 | S | 2/1993 | Hines |
| 5,184,642 | A | 2/1993 | Powell |
| 5,186,360 | A | 2/1993 | Mease et al. |
| D334,266 | S | 3/1993 | Hines |
| 5,193,563 | A | 3/1993 | Melech |
| 5,199,116 | A | 4/1993 | Fischer |
| 5,199,118 | A | 4/1993 | Cole et al. |
| 5,199,188 | A | 4/1993 | Franz |
| 5,202,666 | A | 4/1993 | Knippscheer |
| D336,572 | S | 6/1993 | Gunderson et al. |
| 5,216,251 | A | 6/1993 | Matschke |
| 5,217,035 | A | 6/1993 | Van Marcke |
| 5,224,685 | A | 7/1993 | Chiang et al. |
| 5,226,629 | A | 7/1993 | Millman |
| 5,230,109 | A | 7/1993 | Zacca et al. |
| D338,361 | S | 8/1993 | Hines |
| 5,239,610 | A | 8/1993 | Shao |
| 5,243,717 | A | 9/1993 | Yasuo |
| D340,374 | S | 10/1993 | Hines |
| D340,375 | S | 10/1993 | Hines |
| 5,251,872 | A | 10/1993 | Kodaira |
| 5,253,376 | A | 10/1993 | Fait |
| 5,255,822 | A | 10/1993 | Mease et al. |
| D341,724 | S | 11/1993 | Hines |
| 5,257,423 | A | 11/1993 | Jacobsen et al. |
| 5,259,410 | A | 11/1993 | Trueb et al. |
| 5,265,288 | A | 11/1993 | Allison |
| 5,265,628 | A | 11/1993 | Sage et al. |
| D342,175 | S | 12/1993 | Hines |
| D342,177 | S | 12/1993 | Hanna et al. |
| 5,267,475 | A | 12/1993 | Gaston |
| 5,269,071 | A | 12/1993 | Hamabe et al. |

(56) References Cited

U.S. PATENT DOCUMENTS

| | | | |
|---|---|---|---|
| 5,272,918 | A | 12/1993 | Gaston et al. |
| D342,992 | S | 1/1994 | Robertson |
| 5,280,679 | A | 1/1994 | Edelman |
| D344,830 | S | 3/1994 | Carter et al. |
| 5,341,839 | A | 8/1994 | Kobayashi et al. |
| 5,347,864 | A | 9/1994 | Senghaas et al. |
| 5,351,347 | A | 10/1994 | Kunkel |
| 5,351,417 | A | 10/1994 | Rubin |
| 5,362,026 | A | 11/1994 | Kobayashi et al. |
| 5,363,517 | A | 11/1994 | Botsolas |
| 5,367,442 | A | 11/1994 | Frost et al. |
| 5,369,818 | A | 12/1994 | Barnum et al. |
| 5,377,424 | A | 1/1995 | Albanes |
| 5,377,427 | A | 1/1995 | Mashata |
| D355,949 | S | 2/1995 | Laughton |
| 5,397,099 | A | 3/1995 | Pilolla |
| 5,404,419 | A | 4/1995 | Artis, Jr. |
| 5,412,816 | A | 5/1995 | Paterson et al. |
| 5,412,818 | A | 5/1995 | Chen |
| 5,426,271 | A | 6/1995 | Clark et al. |
| D361,372 | S | 8/1995 | Enthoven |
| 5,438,714 | A | 8/1995 | Shaw |
| 5,438,763 | A | 8/1995 | Yang |
| 5,442,867 | A | 8/1995 | Robinson |
| D362,901 | S | 10/1995 | Dannenberg et al. |
| 5,459,944 | A | 10/1995 | Tatsutani et al. |
| D364,675 | S | 11/1995 | Tebbe |
| 5,477,984 | A | 12/1995 | Sayama et al. |
| 5,482,250 | A | 1/1996 | Kodaira |
| 5,497,135 | A | 3/1996 | Wisskirchen et al. |
| 5,504,950 | A | 4/1996 | Natalizia et al. |
| 5,514,346 | A | 5/1996 | Fujite |
| 5,522,411 | A | 6/1996 | Johnson |
| 5,548,119 | A | 8/1996 | Nortier |
| 5,555,912 | A | 9/1996 | Saadi et al. |
| 5,561,871 | A | 10/1996 | Laughton |
| 5,566,404 | A | 10/1996 | Laughton |
| 5,570,869 | A | 11/1996 | Diaz et al. |
| 5,586,746 | A | 12/1996 | Humpert et al. |
| 5,588,636 | A | 12/1996 | Eiohholz et al. |
| 5,595,216 | A | 1/1997 | Pilolla |
| 5,610,591 | A | 3/1997 | Gallagher |
| 5,611,093 | A | 3/1997 | Barnum et al. |
| 5,611,517 | A | 3/1997 | Saadi et al. |
| 5,625,908 | A | 5/1997 | Shaw |
| 5,627,375 | A | 5/1997 | Hsieh |
| 5,640,781 | A | 6/1997 | Carson |
| 5,642,462 | A | 6/1997 | Huff |
| D380,529 | S | 7/1997 | Laughton |
| 5,651,189 | A | 7/1997 | Coykendall et al. |
| 5,651,384 | A | 7/1997 | Rudrich |
| 5,670,945 | A | 9/1997 | Applonie |
| D387,144 | S | 12/1997 | Flaherty |
| 5,694,653 | A | 12/1997 | Harald |
| 5,699,833 | A | 12/1997 | Tsataros |
| 5,701,929 | A | 12/1997 | Helmsderfer |
| 5,727,579 | A | 3/1998 | Chardack |
| 5,730,165 | A | 3/1998 | Philipp |
| D393,700 | S | 4/1998 | Trueb et al. |
| 5,743,511 | A | 4/1998 | Eichholz et al. |
| D394,495 | S | 5/1998 | Hauser |
| 5,758,688 | A | 6/1998 | Hamanaka et al. |
| 5,765,242 | A | 6/1998 | Marciano |
| 5,769,120 | A | 6/1998 | Laverty, Jr. et al. |
| 5,781,942 | A | 7/1998 | Allen et al. |
| 5,782,382 | A | 7/1998 | Van Marcke |
| D398,969 | S | 9/1998 | Hauser, II |
| 5,813,047 | A | 9/1998 | Teichroeb |
| 5,819,335 | A | 10/1998 | Hennessy |
| 5,819,336 | A | 10/1998 | Gilliam et al. |
| 5,829,072 | A | 11/1998 | Hirsch |
| D402,358 | S | 12/1998 | Bonnell |
| 5,855,356 | A | 1/1999 | Fait |
| 5,868,311 | A | 2/1999 | Cretu-Petra |
| 5,873,178 | A | 2/1999 | Johnson |
| 5,873,179 | A | 2/1999 | Gregory et al. |
| 5,875,562 | A | 3/1999 | Fogarty |
| 5,893,387 | A | 4/1999 | Paterson et al. |
| 5,915,417 | A | 6/1999 | Diaz et al. |
| 5,915,851 | A | 6/1999 | Wattrick et al. |
| D411,876 | S | 7/1999 | Hafner et al. |
| 5,918,855 | A | 7/1999 | Hamanaka et al. |
| 5,924,148 | A | 7/1999 | Flowers, Sr. |
| 5,943,712 | A | 8/1999 | Van Marcke |
| 5,943,713 | A | 8/1999 | Paterson et al. |
| 5,945,068 | A | 8/1999 | Ferone |
| 5,945,913 | A | 8/1999 | Gallagher |
| 5,950,983 | A | 9/1999 | Jahrling |
| 5,954,069 | A | 9/1999 | Foster |
| 5,961,095 | A | 10/1999 | Schrott |
| 5,966,753 | A | 10/1999 | Gauthier et al. |
| 5,972,126 | A | 10/1999 | Fernie |
| 5,974,685 | A | 11/1999 | Hironaka |
| 5,979,500 | A | 11/1999 | Jahrling et al. |
| 5,984,262 | A | 11/1999 | Parsons et al. |
| 5,988,588 | A | 11/1999 | Allen et al. |
| 5,992,430 | A | 11/1999 | Chardack et al. |
| 6,000,429 | A | 12/1999 | Van Marcke |
| 6,003,170 | A | 12/1999 | Humpert et al. |
| 6,006,388 | A | 12/1999 | Young |
| 6,006,784 | A | 12/1999 | Tsutsui et al. |
| D420,727 | S | 2/2000 | Hundley |
| 6,018,885 | A | 2/2000 | Hill |
| 6,029,292 | A | 2/2000 | Leiferman et al. |
| 6,029,293 | A | 2/2000 | Paterson et al. |
| 6,038,786 | A | 3/2000 | Aisenberg et al. |
| D422,346 | S | 4/2000 | Svendsen |
| 6,056,261 | A | 5/2000 | Aparicio |
| 6,059,192 | A | 5/2000 | Zosimadis |
| 6,067,673 | A | 5/2000 | Paese et al. |
| D428,477 | S | 7/2000 | O'Connel et al. |
| 6,082,407 | A | 7/2000 | Paterson et al. |
| 6,089,086 | A | 7/2000 | Swindler et al. |
| 6,110,292 | A | 8/2000 | Jewett et al. |
| D431,288 | S | 9/2000 | Helmsderfer |
| 6,119,285 | A | 9/2000 | Kim |
| D433,109 | S | 10/2000 | Wilke et al. |
| 6,125,482 | A | 10/2000 | Foster |
| 6,127,671 | A | 10/2000 | Parsons et al. |
| 6,128,826 | A | 10/2000 | Robinson |
| 6,131,587 | A | 10/2000 | Chardack et al. |
| 6,142,342 | A | 11/2000 | Lewis |
| 6,161,227 | A | 12/2000 | Bargenquast |
| 6,161,814 | A | 12/2000 | Jahrling |
| D435,893 | S | 1/2001 | Helmsderfer |
| 6,178,572 | B1 | 1/2001 | Van Marcke |
| 6,185,838 | B1 | 2/2001 | Moore |
| 6,189,163 | B1 | 2/2001 | Van Marcke |
| 6,189,230 | B1 | 2/2001 | Huen |
| 6,192,530 | B1 | 2/2001 | Dai |
| 6,199,428 | B1 | 3/2001 | Estevez-Garcia et al. |
| 6,202,980 | B1 | 3/2001 | Vincent et al. |
| 6,206,340 | B1 | 3/2001 | Paese et al. |
| 6,209,392 | B1 | 4/2001 | Rapala |
| 6,212,707 | B1 | 4/2001 | Thompson et al. |
| 6,216,534 | B1 | 4/2001 | Ross, Jr. et al. |
| 6,219,857 | B1 | 4/2001 | Wu |
| 6,219,859 | B1 | 4/2001 | Derakhshan |
| 6,236,317 | B1 | 5/2001 | Cohen et al. |
| 6,250,601 | B1 | 6/2001 | Kolar et al. |
| 6,253,609 | B1 | 7/2001 | Ross, Jr. |
| 6,253,611 | B1 | 7/2001 | Varga et al. |
| 6,257,264 | B1 | 7/2001 | Sturman et al. |
| 6,267,007 | B1 | 7/2001 | Gunther |
| D446,664 | S | 8/2001 | Petri |
| D447,224 | S | 8/2001 | Hauser, II |
| 6,269,695 | B1 | 8/2001 | Cesternino et al. |
| 6,273,394 | B1 | 8/2001 | Voicent et al. |
| 6,279,179 | B1 | 8/2001 | Register |
| 6,279,587 | B1 | 8/2001 | Yamamoto |
| 6,282,812 | B1 | 9/2001 | Wee |
| 6,286,153 | B1 | 9/2001 | Keller |
| 6,289,728 | B1 | 9/2001 | Wilkins |
| 6,294,786 | B1 | 9/2001 | Maricichow et al. |

(56) References Cited

U.S. PATENT DOCUMENTS

| | | | |
|---|---|---|---|
| 6,295,410 | B1 | 9/2001 | Helms et al. |
| D448,585 | S | 10/2001 | Petri |
| 6,298,502 | B1 | 10/2001 | Brown |
| 6,317,717 | B1 | 11/2001 | Lindsey et al. |
| 6,321,785 | B1 | 11/2001 | Bergmann |
| 6,322,005 | B1 | 11/2001 | Kern et al. |
| 6,340,032 | B1 | 1/2002 | Zosimadis |
| 6,341,389 | B2 | 1/2002 | Philipps-Liebich et al. |
| D453,882 | S | 2/2002 | Petri |
| 6,349,484 | B1 | 2/2002 | Cohen |
| 6,351,866 | B1 | 3/2002 | Bragulla |
| 6,363,549 | B2 | 4/2002 | Humpert et al. |
| 6,370,951 | B1 | 4/2002 | Kerchaert et al. |
| 6,386,390 | B1 | 5/2002 | Tinker |
| 6,390,125 | B2 | 5/2002 | Pawelzik et al. |
| 6,393,634 | B1 | 5/2002 | Kodaira et al. |
| 6,401,274 | B1 | 6/2002 | Brown |
| 6,408,881 | B2 | 6/2002 | Lorenzelli et al. |
| 6,431,189 | B1 | 6/2002 | Deibert |
| 6,418,788 | B2 | 7/2002 | Articolo |
| 6,426,701 | B1 | 7/2002 | Levy et al. |
| D462,195 | S | 9/2002 | Wang |
| RE37,888 | E | 10/2002 | Cretu-Petra |
| 6,467,514 | B1 | 10/2002 | Korst et al. |
| 6,467,651 | B1 | 10/2002 | Muderlak et al. |
| 6,481,040 | B1 | 11/2002 | McIntyre |
| 6,481,634 | B1 | 11/2002 | Zosimadis |
| 6,484,965 | B1 | 11/2002 | Reaves |
| 6,508,121 | B2 | 1/2003 | Eck |
| 6,523,193 | B2 | 2/2003 | Saraya |
| 6,523,404 | B1 | 2/2003 | Murphy et al. |
| 6,568,655 | B2 | 5/2003 | Paese et al. |
| 6,572,207 | B2 | 6/2003 | Hase et al. |
| D477,060 | S | 7/2003 | Loberger et al. |
| 6,598,245 | B2 | 7/2003 | Nishioka |
| 6,619,320 | B2 | 9/2003 | Parsons |
| 6,624,606 | B2 | 9/2003 | Kushida et al. |
| 6,639,209 | B1 | 10/2003 | Patterson et al. |
| D481,826 | S | 11/2003 | Martinuzzo et al. |
| 6,641,002 | B2 | 11/2003 | Gerenraich et al. |
| 6,643,865 | B2 | 11/2003 | Bork et al. |
| 6,651,851 | B2 | 11/2003 | Muderlak et al. |
| D483,152 | S | 12/2003 | Martinuzzo et al. |
| 6,658,934 | B1 | 12/2003 | Housey et al. |
| D484,958 | S | 1/2004 | Loberger et al. |
| 6,671,890 | B2 | 1/2004 | Nishioka |
| 6,671,898 | B1 | 1/2004 | Eggenberger et al. |
| 6,679,285 | B2 | 1/2004 | Pablo |
| 6,691,340 | B2 | 2/2004 | Honda et al. |
| 6,691,724 | B2 | 2/2004 | Ford |
| 6,711,949 | B1 | 3/2004 | Sorenson |
| 6,711,950 | B1 | 3/2004 | Yamaura et al. |
| 6,715,730 | B2 | 4/2004 | Ehr |
| 6,766,589 | B1 | 7/2004 | Bory et al. |
| 6,769,197 | B1 | 8/2004 | Tai |
| 6,769,443 | B2 | 8/2004 | Bush |
| 6,770,869 | B2 | 8/2004 | Patterson et al. |
| D496,450 | S | 9/2004 | Loberger et al. |
| 6,812,657 | B2 | 11/2004 | Mario |
| 6,827,294 | B1 | 12/2004 | Fan et al. |
| 6,843,079 | B2 | 1/2005 | Hird |
| 6,857,314 | B2 | 2/2005 | Ohhashi et al. |
| 6,871,541 | B2 | 3/2005 | Weisse |
| 6,882,278 | B2 | 4/2005 | Winings et al. |
| 6,883,563 | B2 | 4/2005 | Smith |
| D507,634 | S | 7/2005 | Loberger et al. |
| 6,912,864 | B2 | 7/2005 | Roche et al. |
| 6,915,690 | B2 | 7/2005 | Okada et al. |
| 6,922,144 | B2 | 7/2005 | Bulin et al. |
| D508,117 | S | 8/2005 | Loberger et al. |
| 6,922,912 | B2 | 8/2005 | Phillips |
| 6,928,235 | B2 | 8/2005 | Pollack |
| 6,929,150 | B2 | 8/2005 | Muderlak et al. |
| D509,577 | S | 9/2005 | Loberger et al. |
| 6,950,606 | B2 | 9/2005 | Logan et al. |
| D511,205 | S | 11/2005 | Loberger et al. |
| D511,821 | S | 11/2005 | Loberger et al. |
| 6,962,005 | B1 | 11/2005 | Khosropour et al. |
| 6,962,168 | B2 | 11/2005 | McDaniel et al. |
| 6,964,405 | B2 | 11/2005 | Marcichow et al. |
| 6,966,334 | B2 | 11/2005 | Bolster |
| 6,968,860 | B1 | 11/2005 | Haenlein et al. |
| D512,648 | S | 12/2005 | Smith et al. |
| 6,980,126 | B2 | 12/2005 | Fournier |
| 6,986,171 | B1 | 1/2006 | Perrin |
| 6,993,968 | B2 | 2/2006 | Kogure |
| 6,996,863 | B2 | 2/2006 | Kaneko |
| 7,007,318 | B1 | 3/2006 | Bork et al. |
| 7,014,166 | B1 | 3/2006 | Wang |
| 7,018,473 | B2 | 3/2006 | Shadrach, III |
| 7,025,227 | B2 | 4/2006 | Oliver et al. |
| 7,039,301 | B1 | 5/2006 | Aisenberg et al. |
| 7,039,963 | B2 | 5/2006 | Loberger et al. |
| 7,079,037 | B2 | 7/2006 | Ross, Jr. et al. |
| D526,394 | S | 8/2006 | Loberger et al. |
| D527,085 | S | 8/2006 | Loberger et al. |
| 7,082,828 | B1 | 8/2006 | Wilkins |
| 7,093,485 | B2 | 8/2006 | Newman et al. |
| D527,809 | S | 9/2006 | Loberger et al. |
| 7,104,519 | B2 | 9/2006 | O'Maley et al. |
| 7,107,631 | B2 | 9/2006 | Lang et al. |
| 7,114,510 | B2 | 10/2006 | Peters et al. |
| 7,150,293 | B2 | 12/2006 | Jonte |
| 7,165,450 | B2 | 1/2007 | Jamnia et al. |
| 7,174,577 | B2 | 2/2007 | Jost et al. |
| D537,927 | S | 3/2007 | Loberger et al. |
| D538,898 | S | 3/2007 | Trepanier |
| D539,400 | S | 3/2007 | Loberger et al. |
| 7,191,484 | B2 | 3/2007 | Dawe |
| 7,191,920 | B2 | 3/2007 | Boll et al. |
| 7,198,175 | B2 | 4/2007 | Ophardt |
| 7,201,052 | B2 | 4/2007 | Lee |
| D542,474 | S | 5/2007 | Churchill et al. |
| 7,219,686 | B2 | 5/2007 | Schmitz et al. |
| 7,228,874 | B2 | 6/2007 | Bolderheij et al. |
| 7,228,984 | B2 | 6/2007 | Tack et al. |
| 7,232,111 | B2 | 6/2007 | McDaniel et al. |
| 7,242,307 | B1 | 7/2007 | LeBlond et al. |
| 7,271,728 | B2 | 9/2007 | Taylor et al. |
| 7,278,624 | B2 | 10/2007 | Iott et al. |
| 7,296,765 | B2 | 11/2007 | Rodrain |
| 7,305,722 | B2 | 12/2007 | Sha et al. |
| 7,315,165 | B2 | 1/2008 | Kleinen et al. |
| 7,318,949 | B2 | 1/2008 | Shadrach, III |
| 7,320,146 | B2 | 1/2008 | Nortier et al. |
| D561,315 | S | 2/2008 | Loberger et al. |
| 7,343,799 | B2 | 3/2008 | Nagakura et al. |
| 7,350,245 | B2 | 4/2008 | Giagni |
| 7,350,413 | B2 | 4/2008 | Nagakura et al. |
| 7,364,053 | B2 | 4/2008 | Ophartd |
| 7,377,163 | B2 | 5/2008 | Miyagawa |
| 7,396,000 | B2 | 7/2008 | Parsons et al. |
| 7,406,722 | B2 | 8/2008 | Fukuizumi et al. |
| 7,409,860 | B2 | 8/2008 | Ferreira et al. |
| 7,437,833 | B2 | 10/2008 | Sato et al. |
| 7,443,305 | B2 | 10/2008 | Verdiramo |
| 7,451,894 | B2 | 11/2008 | Ophardt |
| 7,455,197 | B2 | 11/2008 | Ophardt |
| 7,458,261 | B2 | 12/2008 | Miyagawa |
| 7,464,418 | B2 | 12/2008 | Seggio et al. |
| 7,467,550 | B2 | 12/2008 | Betz, II et al. |
| 7,471,883 | B2 | 12/2008 | Seutter et al. |
| 7,472,433 | B2 | 1/2009 | Redenbeck et al. |
| 7,477,148 | B2 | 1/2009 | Lynn et al. |
| 7,484,409 | B2 | 2/2009 | Dykstra et al. |
| D588,676 | S | 3/2009 | Loberger et al. |
| 7,516,939 | B2 | 4/2009 | Bailey |
| D591,839 | S | 5/2009 | Loberger et al. |
| 7,527,174 | B2 | 5/2009 | Meehan et al. |
| 7,530,269 | B2 | 5/2009 | Newman et al. |
| 7,533,787 | B2 | 5/2009 | Muderlak et al. |
| 7,537,195 | B2 | 5/2009 | McDaniel et al. |
| 7,555,209 | B2 | 6/2009 | Pradas Diez et al. |
| D599,059 | S | 8/2009 | Clerch |

(56) References Cited

U.S. PATENT DOCUMENTS

| | | | |
|---|---|---|---|
| 7,588,168 | B2 | 9/2009 | Bagwell et al. |
| 7,596,883 | B2 | 10/2009 | Kameishi |
| 7,597,122 | B1 | 10/2009 | Smith |
| 7,607,442 | B2 | 10/2009 | Barnhill et al. |
| 7,607,443 | B2 | 10/2009 | Barnhill et al. |
| 7,614,096 | B2 | 11/2009 | Vincent |
| 7,614,160 | B2 | 11/2009 | Kameishi et al. |
| 7,617,830 | B2 | 11/2009 | Barnhill et al. |
| 7,627,909 | B2 | 12/2009 | Esche |
| 7,631,372 | B2 | 12/2009 | Marty et al. |
| 7,641,173 | B2 | 1/2010 | Goodman |
| 7,641,740 | B2 | 1/2010 | Barnhill et al. |
| 7,650,653 | B2 | 1/2010 | Johnson et al. |
| 7,651,068 | B2 | 1/2010 | Bailey |
| D610,242 | S | 2/2010 | Loberger et al. |
| 7,657,162 | B2 | 2/2010 | Itoigawa et al. |
| 7,659,824 | B2 | 2/2010 | Prodanovich et al. |
| 7,681,447 | B2 | 3/2010 | Nagakura et al. |
| 7,682,464 | B2 | 3/2010 | Glenn et al. |
| D614,273 | S | 4/2010 | Loberger et al. |
| 7,690,395 | B2 | 4/2010 | Jonte et al. |
| 7,690,623 | B2 | 4/2010 | Parsons et al. |
| 7,698,770 | B2 | 4/2010 | Barnhill et al. |
| 7,701,164 | B2 | 4/2010 | Clothier et al. |
| 7,721,602 | B2 | 5/2010 | Benner et al. |
| 7,743,438 | B2 | 5/2010 | Chen |
| 7,726,334 | B2 | 6/2010 | Ross, Jr. et al. |
| 7,731,154 | B2 | 6/2010 | Parsons et al. |
| 7,743,782 | B2 | 6/2010 | Jost |
| 7,754,021 | B2 | 7/2010 | Barnhill et al. |
| 7,754,022 | B2 | 7/2010 | Barnhill et al. |
| 7,757,700 | B2 | 7/2010 | Barnhill et al. |
| 7,758,701 | B2 | 7/2010 | Barnhill et al. |
| 17,750,594 | | 7/2010 | Clothier et al. |
| 7,766,026 | B2 | 8/2010 | Boey |
| 7,766,194 | B2 | 8/2010 | Boll et al. |
| 7,774,953 | B1 | 8/2010 | Duran |
| 7,784,481 | B2 | 8/2010 | Kunkel |
| 7,786,628 | B2 | 8/2010 | Childe et al. |
| 7,789,095 | B2 | 9/2010 | Barnhill et al. |
| 7,797,769 | B2 | 9/2010 | Ozenick |
| 7,804,409 | B2 | 9/2010 | Munro et al. |
| D625,792 | S | 10/2010 | Rundberg et al. |
| 7,812,598 | B2 | 10/2010 | Yasuda et al. |
| 7,814,582 | B2 | 10/2010 | Reddy et al. |
| 7,815,134 | B2 | 10/2010 | Hohl |
| 7,818,083 | B2 | 10/2010 | Glenn et al. |
| 7,819,136 | B1 | 10/2010 | Eddy |
| D628,280 | S | 11/2010 | Loberger et al. |
| 7,825,564 | B2 | 11/2010 | Croft et al. |
| RE42,005 | E | 12/2010 | Jost et al. |
| D629,877 | S | 12/2010 | Rundberg et al. |
| 7,856,736 | B2 | 12/2010 | Churchill et al. |
| 7,860,671 | B1 | 12/2010 | LaCaze |
| D633,992 | S | 3/2011 | Rundberg et al. |
| D637,350 | S | 5/2011 | Kato et al. |
| 7,944,116 | B2 | 5/2011 | Causier |
| 7,945,055 | B2 | 5/2011 | Churchill et al. |
| 7,971,368 | B2 | 7/2011 | Fukaya et al. |
| 8,037,619 | B2 | 10/2011 | Liu |
| 8,043,714 | B2 | 10/2011 | Hashimoto |
| 8,064,756 | B2 | 11/2011 | Liu |
| 8,128,465 | B2 | 3/2012 | Collins |
| 8,136,262 | B2 | 3/2012 | Collins |
| D661,023 | S | 5/2012 | Liu et al. |
| 8,561,626 | B2 | 10/2013 | Sawaski et al. |
| 8,698,333 | B2 | 4/2014 | Glasser et al. |
| 8,944,105 | B2 | 2/2015 | Rodenbeck et al. |
| 8,997,271 | B2 | 4/2015 | Bayley et al. |
| 9,639,067 | B2 | 5/2017 | Baba |
| 2001/0011389 | A1 | 8/2001 | Philipps-Liebich et al. |
| 2001/0011390 | A1 | 8/2001 | Humpert et al. |
| 2001/0020619 | A1 | 9/2001 | Pfeifer et al. |
| 2002/0006275 | A1 | 1/2002 | Pollack |
| 2002/0019709 | A1 | 2/2002 | Segal |
| 2002/0104159 | A1 | 8/2002 | Nishioka |
| 2002/0157176 | A1 | 10/2002 | Wawrla et al. |
| 2002/0171056 | A1 | 11/2002 | Paese et al. |
| 2003/0037612 | A1 | 2/2003 | Nagakura et al. |
| 2003/0172547 | A1 | 9/2003 | Shepard |
| 2003/0188380 | A1 | 10/2003 | Loberger et al. |
| 2003/0210140 | A1 | 11/2003 | Menard et al. |
| 2003/0213062 | A1 | 11/2003 | Honda |
| 2004/0016296 | A1 | 1/2004 | Weisse |
| 2004/0025248 | A1 | 2/2004 | Lang et al. |
| 2004/0083547 | A1 | 5/2004 | Mercier |
| 2004/0128755 | A1 | 7/2004 | Loberger et al. |
| 2004/0129075 | A1 | 7/2004 | Sorenson |
| 2004/0143898 | A1 | 7/2004 | Jost et al. |
| 2004/0149799 | A1 | 8/2004 | Boll et al. |
| 2004/0182151 | A1 | 9/2004 | Meure |
| 2004/0221645 | A1 | 11/2004 | Brzozowski et al. |
| 2004/0221646 | A1 | 11/2004 | Ohhashi et al. |
| 2004/0221647 | A1 | 11/2004 | Sebatino |
| 2004/0238660 | A1 | 12/2004 | Fan et al. |
| 2005/0000015 | A1 | 1/2005 | Kaneko |
| 2005/0087557 | A1 | 4/2005 | Oliver et al. |
| 2005/0098968 | A1 | 5/2005 | Dyson et al. |
| 2005/0199843 | A1 | 9/2005 | Jost et al. |
| 2005/0205818 | A1 | 9/2005 | Bayley et al. |
| 2006/0098961 | A1 | 5/2006 | Seutter et al. |
| 2006/0101575 | A1 | 5/2006 | Louis |
| 2006/0102642 | A1 | 5/2006 | Muntzing et al. |
| 2006/0145111 | A1 | 7/2006 | Lang et al. |
| 2006/0150316 | A1 | 7/2006 | Fukuizumi et al. |
| 2006/0151513 | A1 | 7/2006 | Shadrach, III |
| 2006/0185074 | A1 | 8/2006 | Loberger et al. |
| 2006/0200903 | A1 | 9/2006 | Roclenbeck et al. |
| 2006/0207019 | A1 | 9/2006 | Vincent |
| 2006/0225200 | A1 | 10/2006 | Wierenga |
| 2006/0272170 | A1 | 12/2006 | Holmes |
| 2007/0023565 | A1 | 2/2007 | Babikian |
| 2007/0079524 | A1 | 4/2007 | Sato et al. |
| 2007/0094787 | A1 | 5/2007 | Hwang |
| 2007/0144034 | A1 | 6/2007 | Kameishi |
| 2007/0151338 | A1 | 7/2007 | Benner et al. |
| 2007/0152082 | A1 | 7/2007 | Hyslop |
| 2007/0194637 | A1 | 8/2007 | Childe et al. |
| 2007/0230839 | A1 | 10/2007 | Childe et al. |
| 2007/0252551 | A1 | 11/2007 | Clothier et al. |
| 2007/0261162 | A1 | 11/2007 | Atkinson |
| 2007/0263994 | A1 | 11/2007 | Diez et al. |
| 2007/0278983 | A1 | 12/2007 | Clothier et al. |
| 2008/0005833 | A1 | 1/2008 | Bayley et al. |
| 2008/0018995 | A1 | 1/2008 | Baun |
| 2008/0052952 | A1 | 3/2008 | Nelson |
| 2008/0072668 | A1 | 3/2008 | Miyagawa |
| 2008/0078019 | A1 | 4/2008 | Allen, Jr. et al. |
| 2008/0083786 | A1 | 4/2008 | Marin |
| 2008/0098950 | A1 | 5/2008 | Gudjohnsen et al. |
| 2008/0099088 | A1 | 5/2008 | Boey |
| 2008/0109956 | A1 | 5/2008 | Bayley et al. |
| 2008/0127410 | A1 | 6/2008 | Schmitt et al. |
| 2008/0185396 | A1 | 8/2008 | Yang et al. |
| 2008/0185398 | A1 | 8/2008 | Yang |
| 2008/0185399 | A1 | 8/2008 | Yang |
| 2008/0189850 | A1 | 8/2008 | Seggia et al. |
| 2008/0193111 | A1 | 8/2008 | Seutter et al. |
| 2008/0209760 | A1 | 9/2008 | French et al. |
| 2008/0213644 | A1 | 9/2008 | Shindoh et al. |
| 2008/0216343 | A1 | 9/2008 | Churchill et al. |
| 2008/0216344 | A1 | 9/2008 | Churchill et al. |
| 2008/0222910 | A1 | 9/2008 | Churchill et al. |
| 2008/0253754 | A1 | 10/2008 | Rubin |
| 2008/0256825 | A1 | 10/2008 | Hsu |
| 2008/0271527 | A1 | 11/2008 | Hewitt |
| 2008/0285134 | A1 | 11/2008 | Closset et al. |
| 2008/0289098 | A1 | 11/2008 | Kunkel |
| 2008/0301970 | A1 | 12/2008 | Hackwell et al. |
| 2008/0313918 | A1 | 12/2008 | Dyson et al. |
| 2008/0313919 | A1 | 12/2008 | Churchill et al. |
| 2008/0317448 | A1 | 12/2008 | Brown et al. |
| 2009/0000023 | A1 | 1/2009 | Wegelin et al. |
| 2009/0000024 | A1 | 1/2009 | Louis et al. |

(56) References Cited

U.S. PATENT DOCUMENTS

| | | | | |
|---|---|---|---|---|
| 2009/0000142 | A1 | 1/2009 | Churchill | |
| 2009/0000147 | A1 | 1/2009 | Collins | |
| 2009/0031493 | A1 | 2/2009 | Tsujita et al. | |
| 2009/0034946 | A1 | 2/2009 | Simmonds | |
| 2009/0049599 | A1 | 2/2009 | Parsons et al. | |
| 2009/0056011 | A1 | 3/2009 | Wolf et al. | |
| 2009/0058666 | A1 | 3/2009 | Clabaugh | |
| 2009/0069870 | A1 | 3/2009 | Haase et al. | |
| 2009/0077736 | A1 | 3/2009 | Loberger et al. | |
| 2009/0094740 | A1 | 4/2009 | Ji | |
| 2009/0100593 | A1 | 4/2009 | Lincoln et al. | |
| 2009/0113746 | A1 | 5/2009 | Churchill et al. | |
| 2009/0113748 | A1 | 5/2009 | Dyson et al. | |
| 2009/0119832 | A1 | 5/2009 | Conroy | |
| 2009/0119942 | A1 | 5/2009 | Aisenberg et al. | |
| 2009/0126103 | A1 | 5/2009 | Dietrich et al. | |
| 2009/0159612 | A1 | 6/2009 | Beavis et al. | |
| 2009/0236358 | A1 | 9/2009 | Rippl et al. | |
| 2009/0243243 | A1 | 10/2009 | Watson | |
| 2009/0266157 | A1 | 10/2009 | Maruo et al. | |
| 2009/0272445 | A1 | 11/2009 | Shimizu et al. | |
| 2009/0293190 | A1 | 12/2009 | Ringelstetter et al. | |
| 2009/0293192 | A1 | 12/2009 | Pons | |
| 2009/0293304 | A1 | 12/2009 | Yang | |
| 2010/0014844 | A1 | 1/2010 | Dannenberg et al. | |
| 2010/0132112 | A1 | 6/2010 | Bayley et al. | |
| 2010/0139394 | A1 | 6/2010 | Pauer et al. | |
| 2010/0154239 | A1 | 6/2010 | Hutchinson | |
| 2010/0168926 | A1 | 7/2010 | Bayley et al. | |
| 2010/0192399 | A1 | 8/2010 | Sawabe et al. | |
| 2010/0199759 | A1 | 8/2010 | Prasad | |
| 2010/0213208 | A1 | 8/2010 | Bem et al. | |
| 2010/0219013 | A1 | 9/2010 | Liddell | |
| 2010/0223993 | A1 | 9/2010 | Shimizu et al. | |
| 2010/0231392 | A1 | 9/2010 | Sherron | |
| 2010/0236092 | A1 | 9/2010 | Causier | |
| 2010/0252759 | A1 | 10/2010 | Guler et al. | |
| 2010/0269364 | A1 | 10/2010 | Liu | |
| 2010/0276529 | A1 | 11/2010 | Nguyen | |
| 2010/0296799 | A1 | 11/2010 | Liu | |
| 2011/0006083 | A1 | 1/2011 | Walters et al. | |
| 2011/0023319 | A1 | 2/2011 | Fukaya et al. | |
| 2011/0155934 | A1 | 6/2011 | Guler et al. | |
| 2011/0171083 | A1 | 7/2011 | Swistak | |
| 2011/0271441 | A1* | 11/2011 | Bayley ..... | A47K 10/48 4/638 |
| 2011/0277342 | A1 | 11/2011 | Ishii et al. | |
| 2012/0011739 | A1 | 1/2012 | Nakamura | |
| 2012/0017459 | A1 | 1/2012 | Kikuchi et al. | |
| 2012/0017460 | A1 | 1/2012 | Kikuchi et al. | |
| 2012/0055557 | A1 | 3/2012 | Betz et al. | |
| 2012/0285033 | A1 | 11/2012 | Hsu | |
| 2012/0291195 | A1 | 11/2012 | Courtney et al. | |
| 2012/0291303 | A1 | 11/2012 | Courtney et al. | |
| 2013/0025045 | A1 | 1/2013 | Gagnon | |
| 2013/0031799 | A1 | 2/2013 | Gagnon et al. | |
| 2013/0042497 | A1 | 2/2013 | Ryan et al. | |
| 2013/0055588 | A1 | 3/2013 | Nakamara et al. | |
| 2013/0104413 | A1 | 6/2013 | Akiyoshi et al. | |
| 2013/0139400 | A1 | 6/2013 | Fukano | |
| 2013/0199640 | A1 | 8/2013 | Williamson | |
| 2013/0269200 | A1 | 10/2013 | Maloney et al. | |
| 2013/0269201 | A1 | 10/2013 | Courtney et al. | |
| 2013/0276320 | A1 | 10/2013 | Courtney et al. | |
| 2013/0276321 | A1 | 10/2013 | Courtney et al. | |
| 2013/0276328 | A1 | 10/2013 | Gammack et al. | |
| 2013/0283630 | A1 | 10/2013 | Courtney et al. | |
| 2013/0283631 | A1 | 10/2013 | Maloney et al. | |
| 2013/0340272 | A1 | 12/2013 | Courtney et al. | |
| 2014/0007448 | A1 | 1/2014 | Courtney et al. | |
| 2014/0007449 | A1 | 1/2014 | Courtney et al. | |
| 2015/0048160 | A1 | 2/2015 | Graydon | |
| 2015/0135429 | A1 | 5/2015 | Dyson | |
| 2015/0164288 | A1 | 6/2015 | Courtney et al. | |
| 2015/0164289 | A1 | 6/2015 | Courtney et al. | |

FOREIGN PATENT DOCUMENTS

| | | | |
|---|---|---|---|
| AU | 2006274708 | | 2/2007 |
| AU | 2006274715 | | 2/2007 |
| BE | 347407 | | 12/1927 |
| CN | 102665512 | | 9/2012 |
| DE | 504089 | | 7/1930 |
| DE | 2018695 | | 10/1971 |
| DE | 2304815 | | 8/1974 |
| DE | 2657164 | | 12/1976 |
| DE | 7707416 | | 7/1977 |
| DE | 3036623 | | 2/1982 |
| DE | 4218658 | | 12/1992 |
| DE | 9304270 | | 9/1993 |
| DE | 9304160 | | 7/1994 |
| DE | 19608157 | | 7/1997 |
| DE | 10210474 | | 9/2002 |
| DE | 69821140 | | 11/2004 |
| DE | 20-2004-012352 | | 12/2004 |
| DE | 20-2005-018472 | | 2/2006 |
| DE | 10-2009-003070 | | 11/2010 |
| EP | 0274785 | | 7/1988 |
| EP | 1057942 | | 12/2000 |
| EP | 1241301 | | 9/2002 |
| EP | 1250878 | | 10/2002 |
| EP | 1258568 | | 11/2002 |
| EP | 1057441 | | 9/2006 |
| EP | 1912549 | | 3/2010 |
| EP | 2177142 | | 4/2010 |
| EP | 2277424 | | 1/2011 |
| EP | 2554085 | | 12/2013 |
| GB | 549766 | | 12/1942 |
| GB | 737054 | | 9/1955 |
| GB | 909069 | | 10/1962 |
| GB | 915674 | | 1/1963 |
| GB | 2249026 | | 4/1992 |
| GB | 2358350 | | 7/2001 |
| GB | 2380676 | | 4/2003 |
| GB | 2450563 | | 12/2008 |
| JP | 61-179993 | | 11/1936 |
| JP | 49-037685 | | 4/1974 |
| JP | 1-71575 | | 5/1989 |
| JP | 1256632 | | 10/1989 |
| JP | 3-125861 | | 12/1991 |
| JP | 04-221523 | | 8/1992 |
| JP | 04-136195 | | 12/1992 |
| JP | 5-7752 | | 2/1993 |
| JP | 5163748 | | 6/1993 |
| JP | 05-055988 | | 7/1993 |
| JP | 06-062977 | | 3/1994 |
| JP | 07-116076 | | 5/1995 |
| JP | 8-140891 | | 6/1996 |
| JP | 08-164088 | | 6/1996 |
| JP | 08-196470 | | 8/1996 |
| JP | 08-266939 | | 10/1996 |
| JP | 9-056640 | | 3/1997 |
| JP | 9-135788 | | 5/1997 |
| JP | 09-215631 | | 8/1997 |
| JP | 9242155 | | 9/1997 |
| JP | 10-113304 | | 5/1998 |
| JP | 10-113305 | | 5/1998 |
| JP | 10-248748 | | 9/1998 |
| JP | 10-257992 | | 9/1998 |
| JP | 11-000283 | | 1/1999 |
| JP | 11-113789 | | 4/1999 |
| JP | 11-169317 | | 6/1999 |
| JP | 11-244190 | | 9/1999 |
| JP | 2000-000178 | | 1/2000 |
| JP | 2000-000180 | | 1/2000 |
| JP | 2000-157448 | | 6/2000 |
| JP | 2000-184987 | | 7/2000 |
| JP | 2000262433 | A | 9/2000 |
| JP | 2000-271039 | | 10/2000 |
| JP | 2000-282528 | | 10/2000 |
| JP | 2000-300461 | | 10/2000 |
| JP | 2001-003407 | | 1/2001 |
| JP | 2001404213 | | 4/2001 |
| JP | 2001-140305 | | 5/2001 |
| JP | 2001-346715 | | 12/2001 |

(56) References Cited

FOREIGN PATENT DOCUMENTS

| | | | |
|---|---|---|---|
| JP | 2002-028100 | | 1/2002 |
| JP | 2002115303 | A | 4/2002 |
| JP | 2002-136448 | | 5/2002 |
| JP | 2002-345682 | | 12/2002 |
| JP | 2003-153823 | | 5/2003 |
| JP | 2003275112 | A | 9/2003 |
| JP | 2004-215879 | | 8/2004 |
| JP | 2004-261510 | | 9/2004 |
| JP | 2005-168799 | | 6/2005 |
| JP | 2006-081925 | | 3/2006 |
| JP | 2006-101987 | | 4/2006 |
| JP | 2006-192250 | | 7/2006 |
| JP | 2006-204738 | | 8/2006 |
| JP | 2006-304926 | | 11/2006 |
| JP | 2007-054670 | | 3/2007 |
| JP | 2007-082904 | | 4/2007 |
| JP | 2007-098106 | | 4/2007 |
| JP | 2007143584 | | 6/2007 |
| JP | 2007209459 | A | 8/2007 |
| JP | 2008-005883 | | 1/2008 |
| JP | 2008-080100 | | 4/2008 |
| JP | 2008-099797 | | 5/2008 |
| JP | 2008-110240 | | 5/2008 |
| JP | 2008-272086 | | 11/2008 |
| JP | 2008-272251 | | 11/2008 |
| JP | 2009088657 | A | 4/2009 |
| JP | 2010-046238 | | 3/2010 |
| JP | 2010-075602 | | 4/2010 |
| JP | 2010-110450 | | 5/2010 |
| JP | 3-160341 | | 6/2010 |
| JP | 2011019606 | A | 2/2011 |
| JP | 2011-055859 | | 3/2011 |
| KR | 100711544 | | 4/2007 |
| KR | 20120070020 | | 6/2012 |
| MX | 2014011247 | | 11/2015 |
| NL | 1017777 | | 10/2002 |
| TW | 567822 | | 12/2003 |
| TW | 408638 | | 8/2011 |
| WO | 96/26795 | | 9/1995 |
| WO | 01/16436 | | 3/2001 |
| WO | 2006/055681 | | 5/2006 |
| WO | 2007/011747 | | 1/2007 |
| WO | 2007/015036 | | 2/2007 |
| WO | 2007/015039 | | 2/2007 |
| WO | 2007/015046 | | 2/2007 |
| WO | 2009/039290 | | 3/2009 |
| WO | 2009/062546 | | 5/2009 |
| WO | 2010/088975 | | 8/2010 |
| WO | 2010/089927 | | 8/2010 |
| WO | 2010/095250 | | 8/2010 |
| WO | 2010/095251 | | 8/2010 |
| WO | 2010/119536 | | 10/2010 |
| WO | 2011/009156 | | 1/2011 |
| WO | 2011/044247 | | 4/2011 |
| WO | 2011/074018 | | 6/2011 |
| WO | 2011/077625 | | 6/2011 |

* cited by examiner

MULTI-PURPOSE HAND WASHING STATION

CROSS-REFERENCE TO RELATED APPLICATION

This application claims a benefit of priority under 35 USC § 119 based on U.S. Provisional Patent application No. 61/692,982 filed Aug. 24, 2012, and is also a national phase filing of international application no. PCT/US2013/031162, the entire contents of both which are hereby expressly incorporated by reference into the present application.

BACKGROUND OF THE INVENTION

1. Field of the Invention

The present invention relates generally to the field of lavatory systems and, more particularly, to a multi-purpose hand washing station with a soap dispenser, multiple air plenums with reinforcing grids that make up a hand drying system, and a water trap with a series of air hoses that supply air to the multiple air plenums.

2. Discussion of the Related Art

Lavatory systems are generally shown and described in U.S. patent application Ser. Nos. 12/233,466, 13/122,368, and 13/088,793. An exemplary lavatory system is described in the U.S. application Ser. No. 13/088,793, which is assigned to Bradley Fixtures Corporation, the assignee of this application. The '793 application, which is expressly incorporated by reference herein, describes a lavatory system in which a hand washing station has a wash basin, a faucet, and an electric hand dryer. The integration of these components into a single wash station alleviates the need for a user to leave the wash station to access a hand dryer. That is, the hand dryer is adjacent the wash basin and blows into an area generally above the wash basin. Accordingly, a user can water and soap his hands in a conventional manner and then move his hands to the drying zone of the hand dryer. The user's hands do not need to leave the wash basin for the hands to be exposed to the drying air. Hence, water does not drip onto the floor as the user presents his hands to the dryer, and water wicked from the hands is blown into the wash basin rather than onto the floor.

SUMMARY AND OBJECTS OF THE INVENTION

By way of summary, the present invention is directed to a multi-purpose lavatory system. An object of the present invention is to provide an easy way to monitor and fill a soap dispenser's fluid level in a multi-purpose hand washing station. An additional object of the invention is to provide one or more air plenums for a hand dryer in a multi-purpose hand washing station that is equipped with a series of raised shapes molded into the air plenums for providing structural rigidity when the air plenums are provided with air pressure. Another object of the invention is to provide a water trap in one or more of the air hoses that supply air pressure to the air plenums to prevent water from flowing through the air hoses and into a blower that generates the air pressure.

A multi-purpose hand washing station is herein disclosed. The multi-purpose hand washing station includes a base and is attached to a support structure, and the support structure is attached to a wall. A top air plenum may be attached to a top side of the basin. A top air plenum is located within a top air plenum hood and is configured to direct air through a plurality of air outlets pointed in the direction of the basin. The top air plenum includes at least one air inlet that is supplied air by an air hose. A bottom air plenum is attached to a bottom side of the basin directly below the top air plenum. Just like the top air plenum, the bottom air plenum includes at least one air inlet that is supplied air by an additional hose and a plurality of air outlets that direct air flow upward in a direction toward the top air plenum. The plurality of air outlets on the bottom air plenum projects through the basin via an opening in the basin. A blower mounted below the basin is configured to generate and supply air pressure to the top air plenum and the bottom air plenum via air hoses.

The air plenum air hoses include a first air hose with a first and second end and a second air hose with a first and a second end. The first end of the first air hose is connected to the top air plenum's air inlet and the second end of the first hose is connected to the blower. The first end of the second air hose is connected to the air inlet of the bottom plenum and the second end of the second air hose is connected to the blower. The second air hose includes a vertical length extending from the air inlet of the bottom air plenum in an upward, generally vertical direction for a distance and then makes an about 150-180° bend inside the top air plenum hood to extend the second hose in a downward, generally vertical direction for a distance, and attaches the second end of the second air hose to the blower. The about 150-180° bend is secured to the top air plenum hood with a fastener that may include a zip tie, a screw, a bolt, or any other known fastener. This bend functions to prevent water from entering the bottom air plenum and flowing through the second air hose and into the blower by forming a U-shape or an inverted p-trap. In this configuration, the force of gravity on water in one side of the U-shaped bend prevents the ability of the water to communicate (or flow) to the other side of the U-shaped bend. The first and second air hose may be made out of any known hose material including corrugated tubing, rubber tubing, vinyl tubing, silicone tubing, plastic tubing, hard molded tubing, or any other known air supply ducting. The first and second air hoses may attach to the plenums and the blower with any known fastening means including worm gear hose clamps, t-bolt hose clamps, twist-to-connect fittings, quick release fittings, or any other known clamping means.

It should be noted that the bend in the hose does not need to be exactly 150-180°. In fact, a bend between greater than 90° and less than 360° is possible.

The top and the bottom air plenums are constructed in a two-part fashion. A top half shell is joined to a bottom half shell forming an interior space within the air plenum. Either the top half shell or the bottom half shell includes a plurality of air outlets integrated into the respective half shell. Each one of the top half shells and the bottom half shells include half an air inlet so that when the two half shells are joined together, a complete air inlet is formed. Each half shell further may include multiple ribs that form a grid-like structure on either the exterior side and/or within the interior space of the half shell. The grid-like structure is formed of a plurality of raised shapes that are molded into the half shell. The raised shapes may include a plurality of squares to form a raised checkerboard-like structure, but also may include a plurality of raised shapes including circles or polygons. The grid functions to provide structural support to each half shell and the assembled air plenums so that the air pressure that is generated by the blower does not deform the plenum's shape. The grid prevents the plenum from expanding or contracting under the supplied air pressure. Alternatively, a distribution air plenum may be used as the top air plenum or the bottom air plenum. The distribution air plenum is similar to the top and bottom air plenums except it includes more than one air inlet and allows the air supplied by the blower to be more evenly distributed to the air outlets.

Also attached to the basin is a soap dispenser to dispense liquid soap. The soap dispenser is formed by a multi-piece construction. A lid is pivotably attached to a base by a hinge. The lid is held closed and attached to the base by a clasp. A provision is made adjacent to the clasp for a single fastener to hold the lid closed for added security. A clasp key may release the clasp. Releasing the clasp allows the lid to pivot open exposing a funnel insert that is inserted into the base and includes a recessed channel around the perimeter of the funnel. The recessed channel terminates at a fill port allowing a user to conveniently pour a hand cleaner, preferably, a liquefied soap into the fill port; however, the recessed channel will capture spilled soap and funnel it to the fill port. On a bottom side of the base, a reservoir mount that is in fluid communication with the fill port allows attachment of a fluid reservoir for capturing and retaining the soap that is poured into the fill port and recessed channel. A level sensor that extends downwardly from the reservoir mount includes a float attached to a rod. The float is buoyant in the liquid soap allowing the level sensor to sense the level of liquid soap in a reservoir that is attached to the reservoir mount. An indicator light on the base conveniently notifies a user of the sensed level of liquid soap in the reservoir. A pump connected to the reservoir pumps soap from the reservoir to a soap outlet on the soap dispenser when the user activates the pump.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
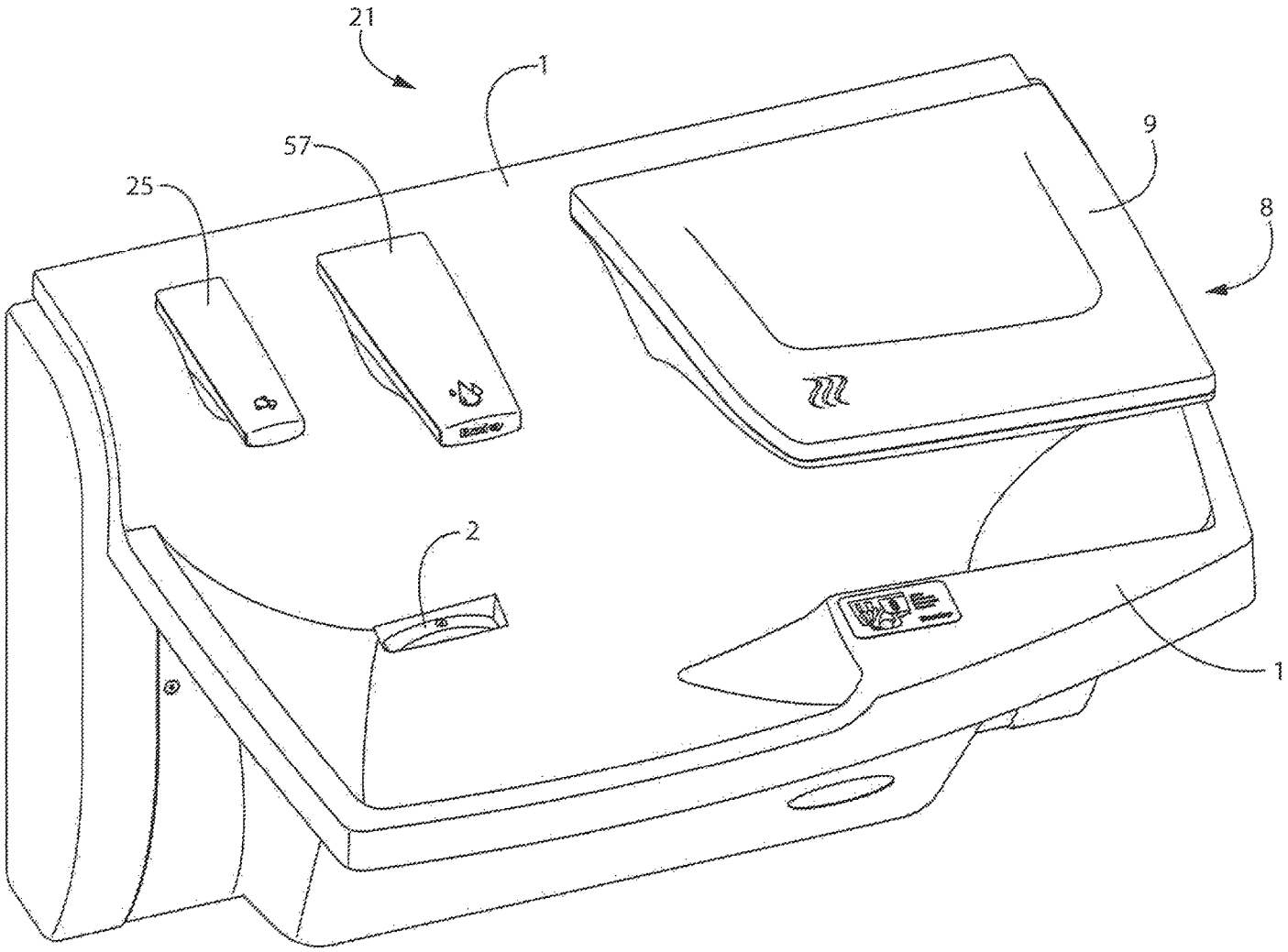
FIG. 1 illustrates a perspective view of the multi-purpose hand washing station of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF PREFERRED EMBODIMENTS

The present invention and the various features and advantageous details thereof are explained more fully with reference to the non-limiting embodiments described in detail in the following description.

Beginning with FIG. 1, a multi-purpose hand washing station 21 is shown. A basin 1 with a top side 16 allows a user to conveniently wash his hands by using a faucet 57. Water from the faucet 57 is funneled by the contour of the top side 16 of the basin 1 into a drain 2. The user may also dispense a hand cleaner, e.g., a liquid soap, from a dispenser 25. After hand washing is completed, a hand dryer 8 allows the user to dry his hands. The hand dryer 8 includes a top air plenum hood 9 and a series of air plenums seen in the following Figs.

Figure 2:
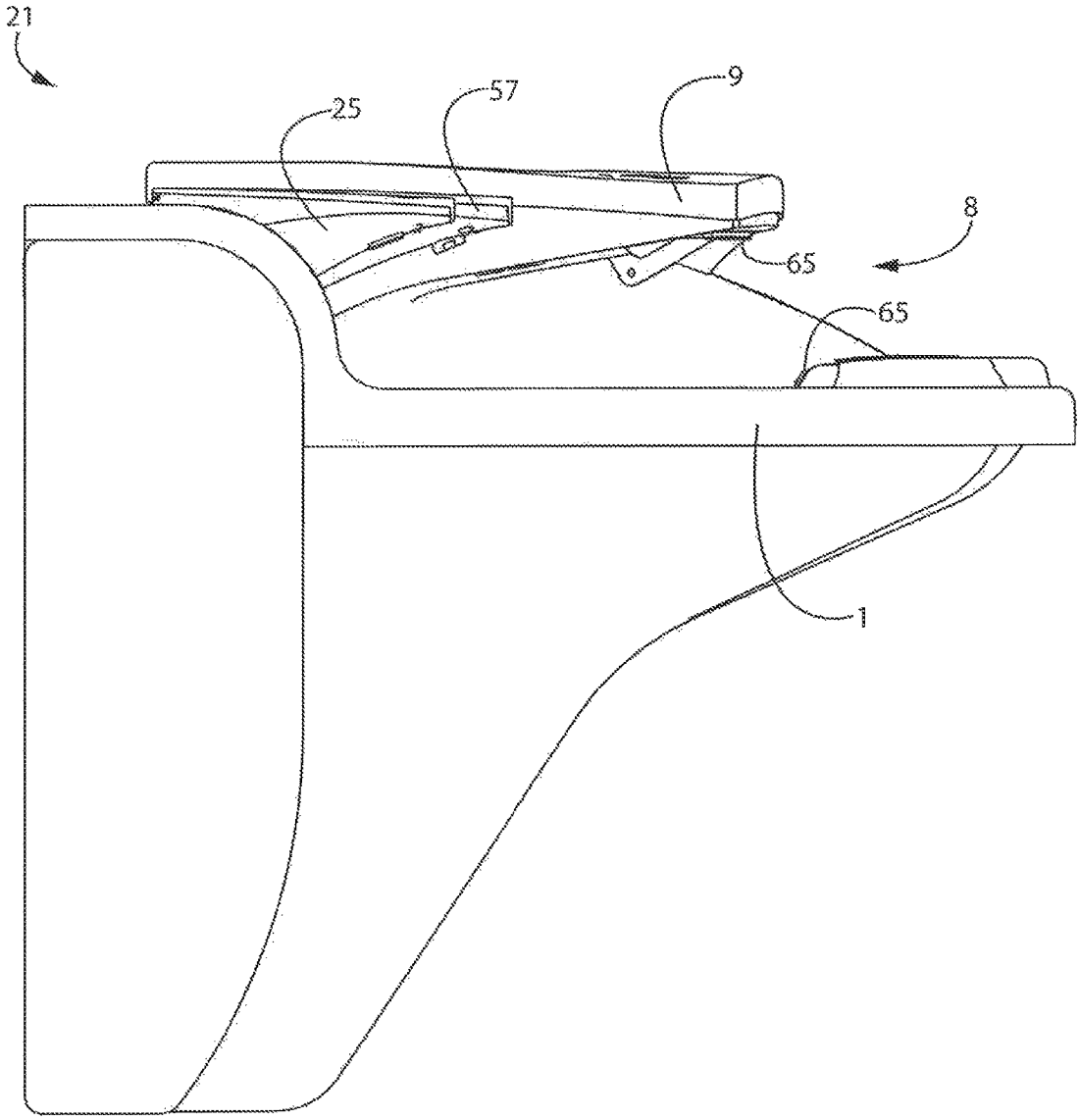
FIG. 2 is a side view of the multi-purpose hand washing station according to the present invention.

FIG. 2 shows a side view of the multi-purpose hand washing station 21. The basin 1 is shown supporting each one of the soap dispenser 25, the faucet 57, and the hand dryer 8. The air outlets 65 of the hand dryer 8 that supply pressurized streams of air for hand drying are also visible in this view.

Figure 3:
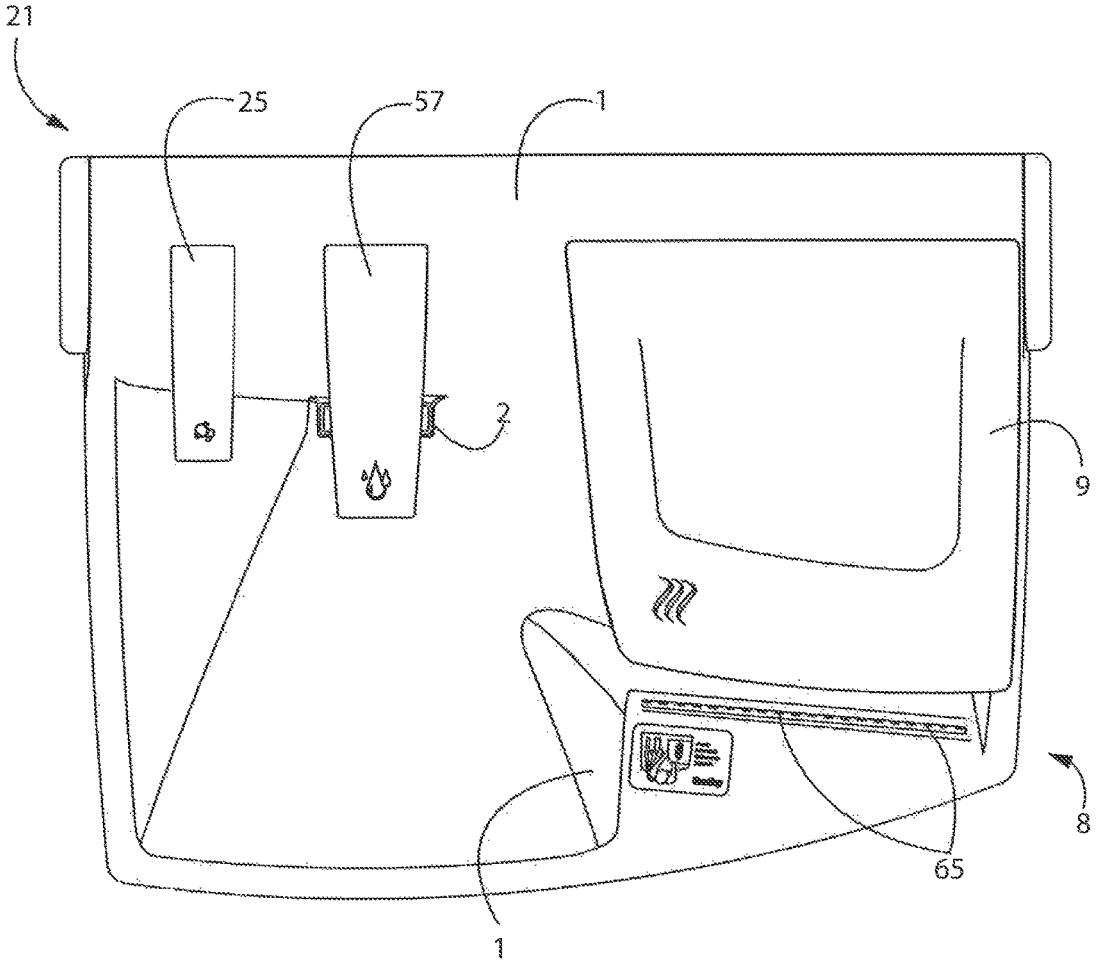
FIG. 3 is a top view of the multi-purpose hand washing station according to the present invention.

Turning to FIG. 3, a top view of the multi-purpose hand washing station 21 is shown. The air outlets 65, of the not-pictured bottom air plenum 7, are shown projecting from the top side 16 of the basin 1. The soap dispenser 25, faucet 57, top air plenum hood 9, and a drain 2 are all shown attached to the basin 1.

Figure 4:
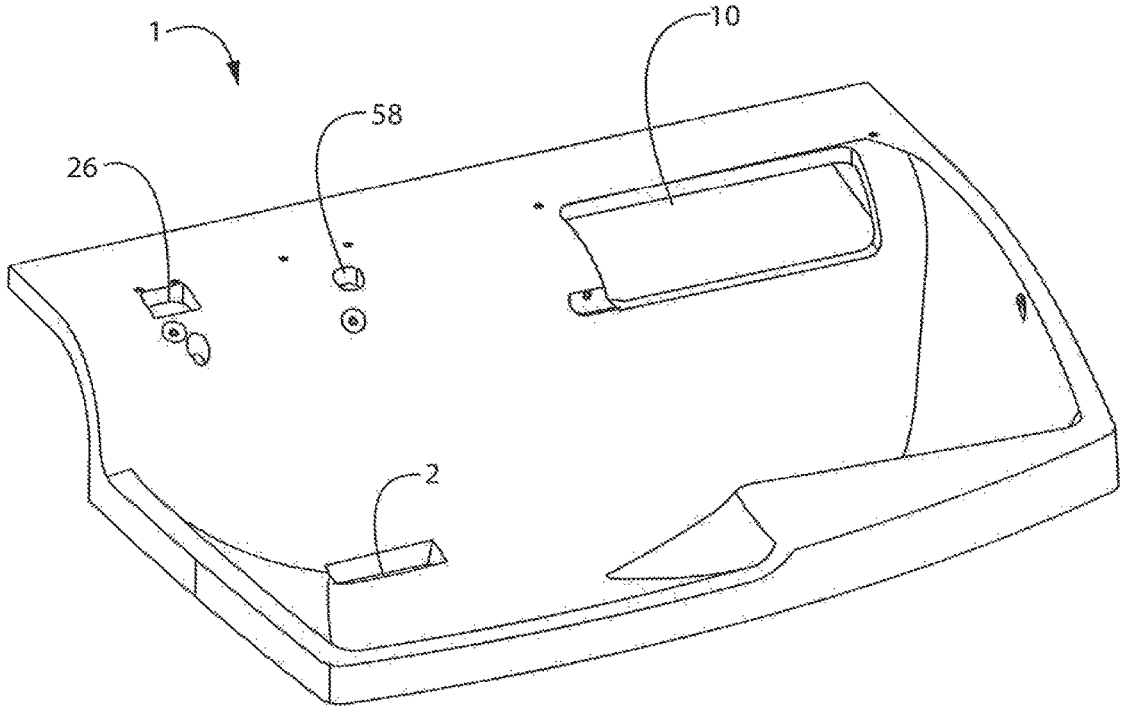
FIG. 4 is a perspective view of the basin from the multi-purpose hand washing station according to the present invention.

FIG. 4 shows the top side 16 of the basin 1 without anything attached. The soap dispenser mount 26 allows for attachments of the soap dispenser 25, the faucet mount 58 allows for attachment of the faucet 57 and the top air plenum hood mount 10 allows for attachment of the top air plenum hood 9. The drain 2 is also integrated into the base 1. The contour of the basin 1 allows for not only water from the faucet 57 to flow to the drain 2 but also water from a user's hands while the hand dryer 8 is in use will also flow to the drain 2.

Figure 5:
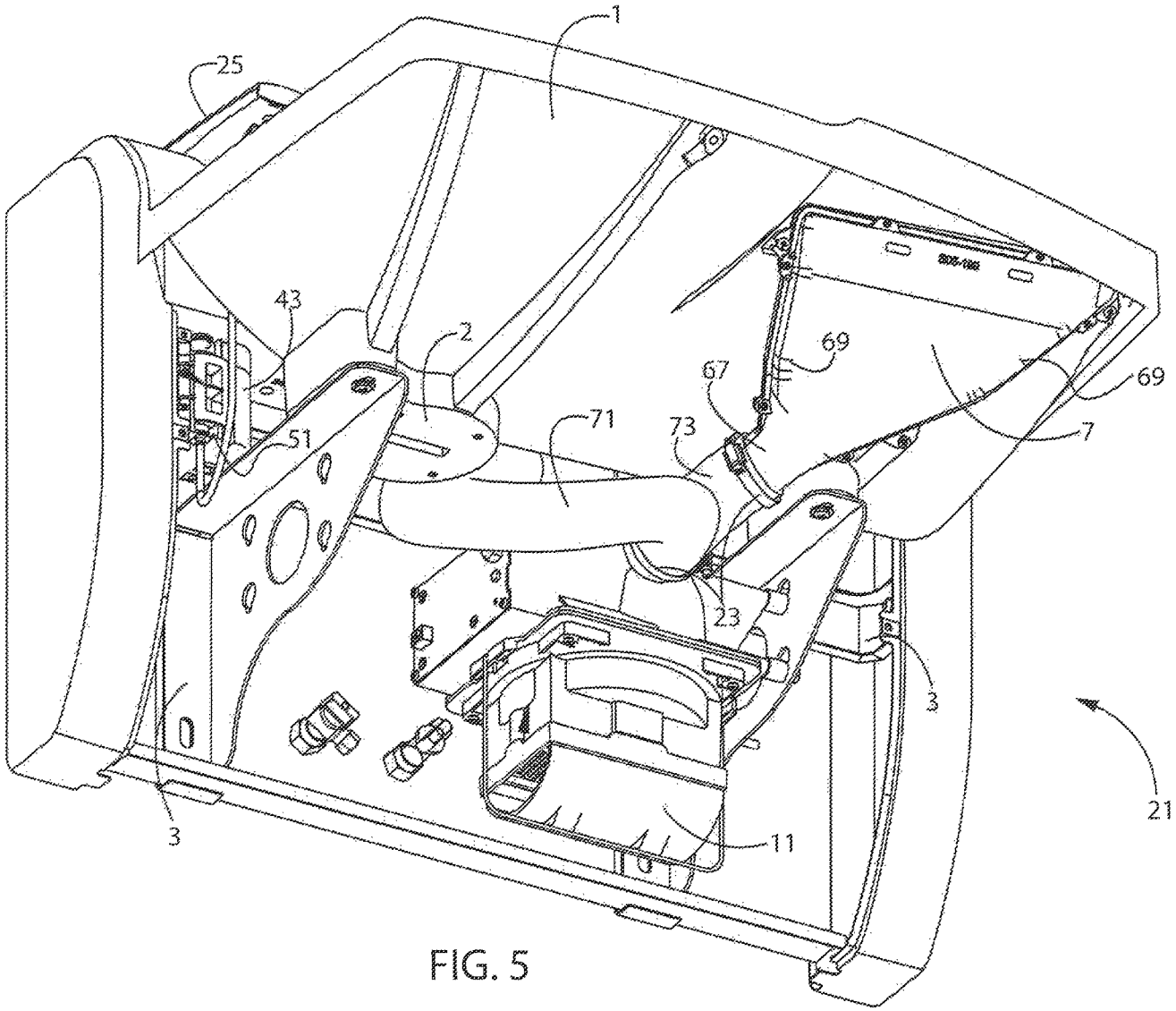
FIG. 5 is a partial elevation view of the multi-purpose hand washing station according to the present invention showing the exposed underside of the basin.

Transitioning now to FIG. 5, the bottom side 4 of the basin 1 is shown along with all the various attachments. The bottom air plenum 7 is shown attaching to the underside of the basin 1. A first end 76 of the second air hose 73 attaches to the air inlet 67 of the bottom air plenum 7 with a hose clamp 23. A series of ribs that forms grids 69 is shown molded into the bottom air plenum 7. The grids 69 provide structural support to either air plenum 5 or 7 in order to prevent deformation when air pressure is supplied to the top and bottom air plenums 5, 7 by a blower 11. The blower 11 attaches to the multi-purpose hand washing station 21 with a support structure 3. The support structure 3 holds all the various components of the multi-purpose hand washing station 21 together. A reservoir 43 contains a liquid soap. A soap pump 51 pumps the liquid soap stored in the reservoir 43 to the soap dispenser 25. The drain 2 on the underside of the basin 1 may be connected to any suitable plumbing system such as a sewer, a septic system, a holding tank, or any other similar device. The second end 74 of the first air hose 71 connects to the blower 11 with the hose clamp 23 and is routed behind the basin 1 into the top air plenum hood 94. The first air hose 71 attaches to the top air plenum 5, inside the top air plenum hood 9, seen for example in FIG. 7.

Figure 6:
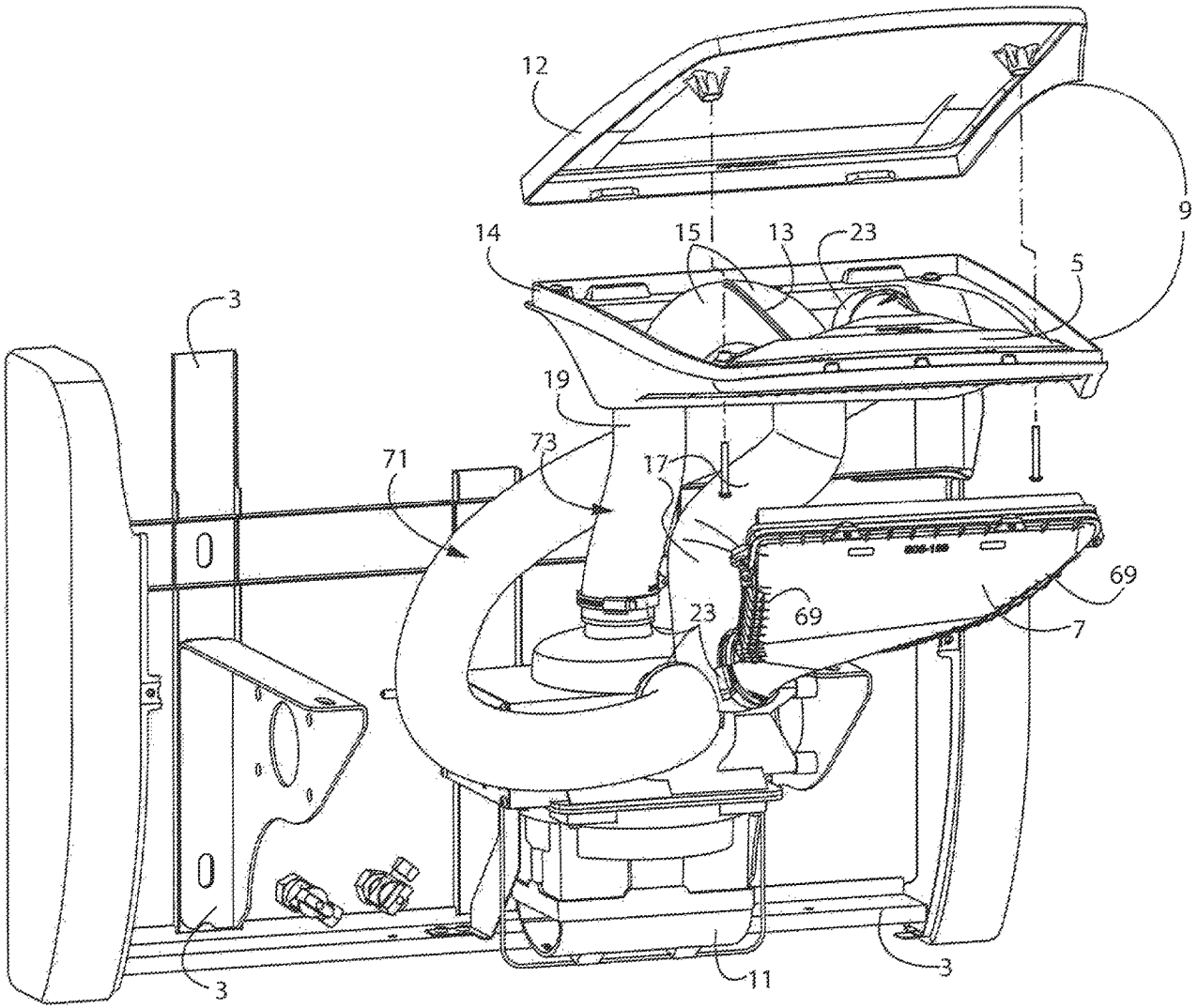
FIG. 6 is a partial perspective view of the multi-purpose hand washing station according to the present invention, without the basin, exposing the air plenums and air hoses.
Figure 7:
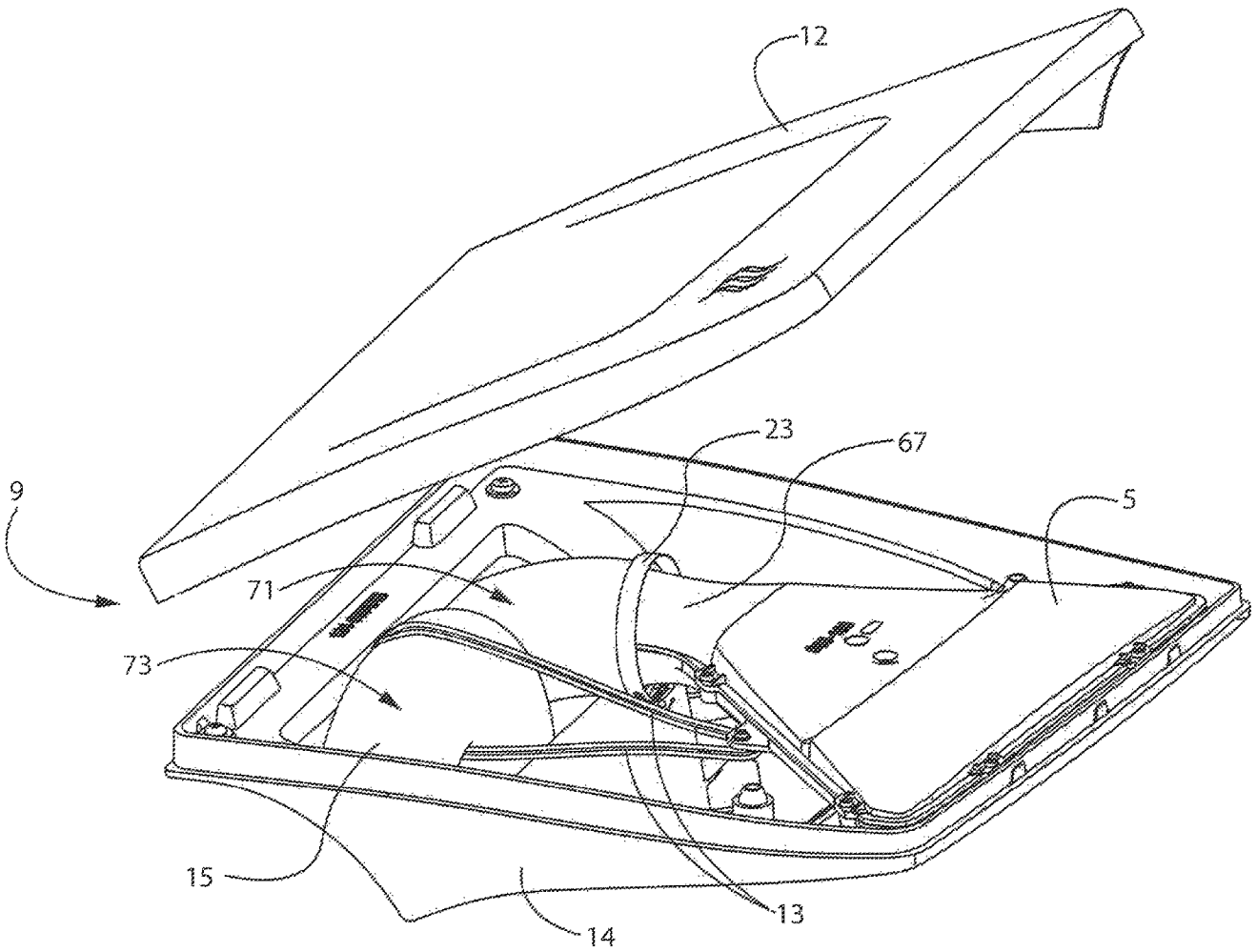
FIG. 7 is a partially exploded perspective view of the top air plenum hood showing the top air plenum, first and second air hoses, and the 180° bend.

FIG. 6 shows a partially exploded view of the multi-purpose hand washing station 21. The support structure 3 is shown and may be attached to a rigid device such as a wall. The top air plenum hood 9 is shown partially exploded thereby exposing the interior top air plenum 5 and the second air hose 73. The top air plenum hood 9 includes a top air plenum hood top half 12 and a top air plenum hood bottom half 14 which are held together with any known fastening means, such as screws 18. The second air hose 73 is connected at the second end 76 to the bottom air plenum 7 with the hose clamp 23 and travels in an upward vertical direction 17 and into the top air plenum hood 9. At this point, the second air hose 73 transitions into a generally U-shaped bend 15, and then continues in a downward vertical direction 19 until the second end 78 attaches to the blower 11 and is connected to the blower 11 with the hose clamp 23. The 180° bend is attached to the top air plenum hood 9 with a fastener 13. The fastener 13 may include any known fastening means including a bolt, a screw, a zip tie, a cable tie, or any other known fastening device. The fastener 13 holds the generally U-shaped bend 15 above the air outlets 65 in the bottom air plenum 7, in the vertical direction, in order to prevent water which enters the bottom air plenum's air outlets 65 from reaching the blower 11. The basin 1 is designed to prevent water from entering the bottom air plenum 7; however, with vigorous use or through negligence it is possible for a user to force water into the air outlets 65 of the bottom air plenum 7. In the present configuration, should water enter the bottom air plenum 7, it may only fill the second air hose up to a distance even with the air outlets 65 of the bottom air plenum 7. The force of gravity prevents water from flowing into the generally U-shaped bend and into the blower 11, while the fastener 13 prevents the weight of the water in the upward vertical direction 17 of the second air hose 73 from pulling the second air hose 73 down and allowing the water to enter the blower 11. The second end 74 of the first air hose 71 also attaches to the blower 11 with a hose clamp 23 and the first end 68, better seen in FIG. 7, is also connected to the top air plenum 5 with a hose clamp 23. Because the top air plenum 5 is located vertically above the basin 1, as seen in FIGS. 1 and 2, water may not enter the top air plenum 5.

Turning now to FIG. 7 a partially exploded view of the top air plenum hood 9 is shown. The top air plenum hood top half 12 is separated from the top air plenum hood bottom half 14. The top air plenum 5 is attached to the top air plenum hood bottom half 14 with multiple screws 18 seen for example in FIG. 6. The first end 68 of the air hose 71 is shown attaching to the air inlet 67 of the top air plenum 5 with a hose clamp 23. The generally U-shaped bend 15 of the second air hose 73 is shown attaching to the top air plenum hood bottom half 14 and to the top air plenum 5 with a fastener 13.

Figure 8:
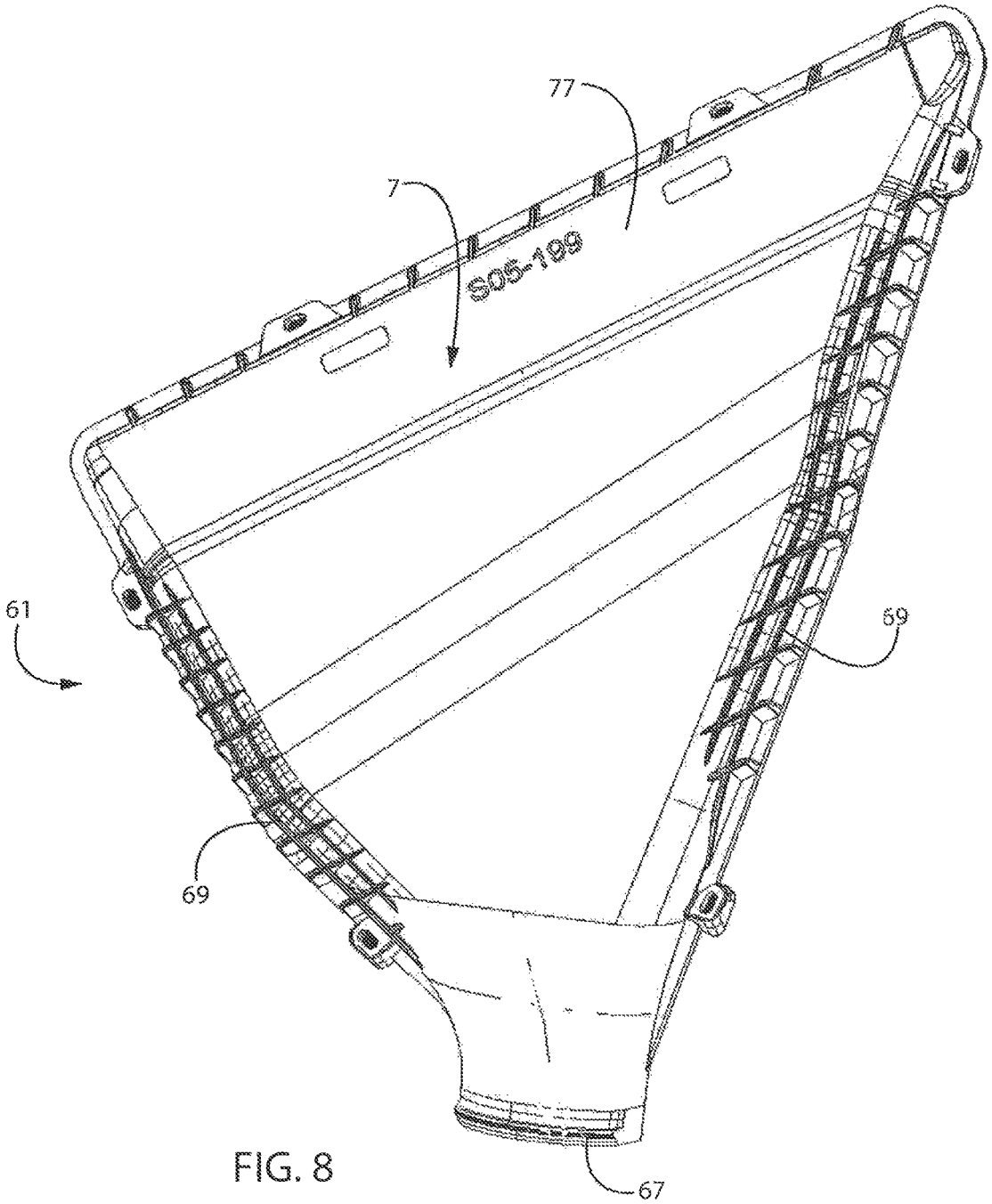
FIG. 8 is a bottom view of the bottom half shell of the bottom air plenum.

FIG. 8 discloses the bottom half shell 61 of the bottom air plenum 7. Both the top air plenum 5 and the bottom air plenum 7 are formed with a top half shell 59 joining a bottom half shell 61. While the pictured bottom air plenum 7 shows grids 69 along the edges of the bottom half shell 61, the grids 69 may be included along the entirety of the exterior side 77 and also along the entirety of the interior side 75, as seen, for example, in FIG. 10. The grids 69 include a series of raised rectangular shapes that are molded into the exterior side 77 of the respective half shell; however, the grids may be circular in shape, square in shape, or shaped in any variety of shapes. The air inlet 67 allows for attachment of the second air hose 73 as seen, for example, in FIG. 6.

Figure 9:
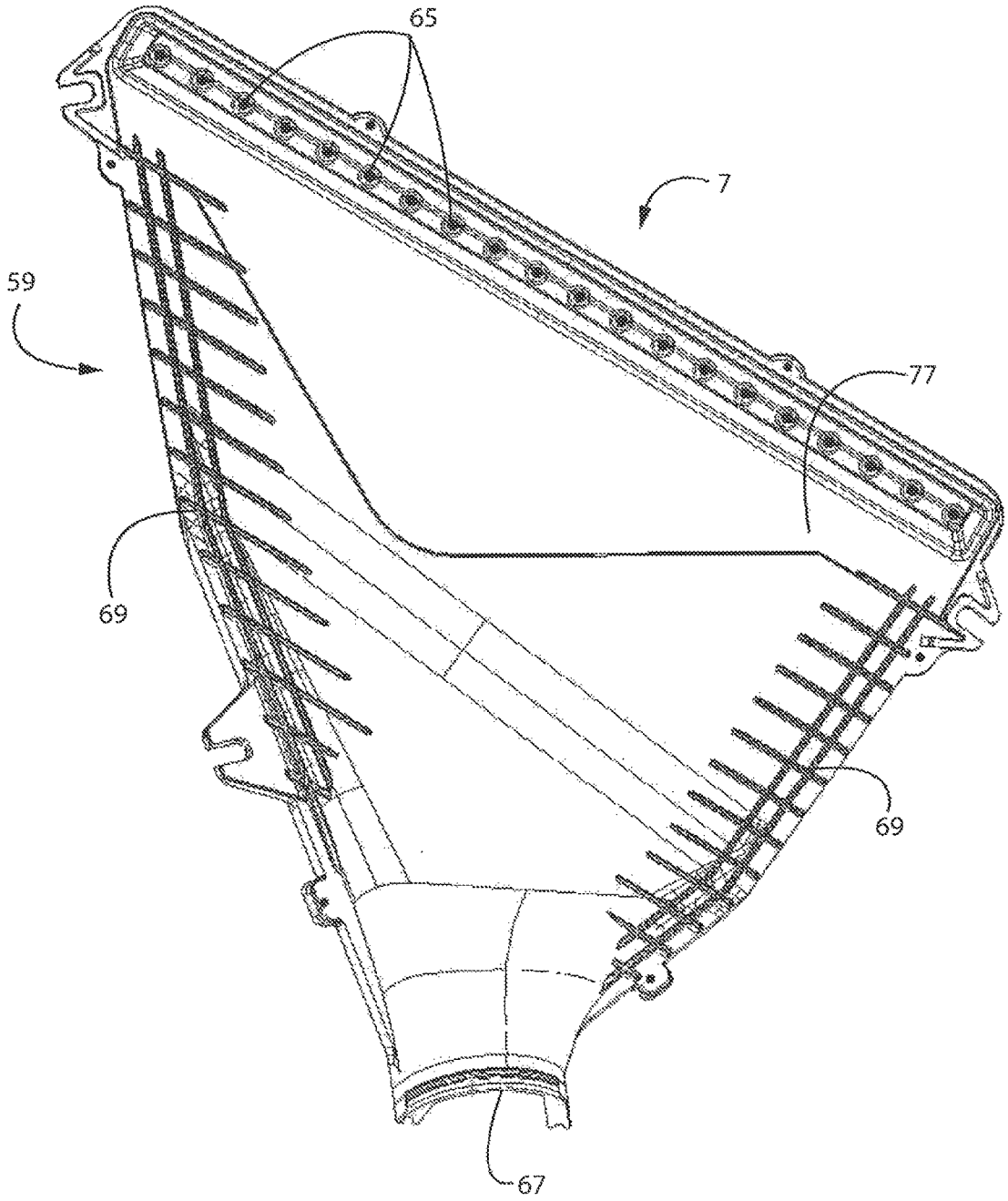
FIG. 9 is a top view of the top half shell of the bottom air plenum.

FIG. 9 shows the exterior side 77 of the top half shell 59 of the bottom air plenum 7. The air outlets 65 that project through the basin 1, as shown in FIG. 2 and described above, are visible. The grids 69 are shown along the edges of the top half shell 59; however, the grids 69 may cover the entirety of the top half shell. The grids 69 include a plurality of raised shapes 70. The air inlet 67 allows for attachment of second air hose 73, as seen in FIG. 6.

Figure 10:
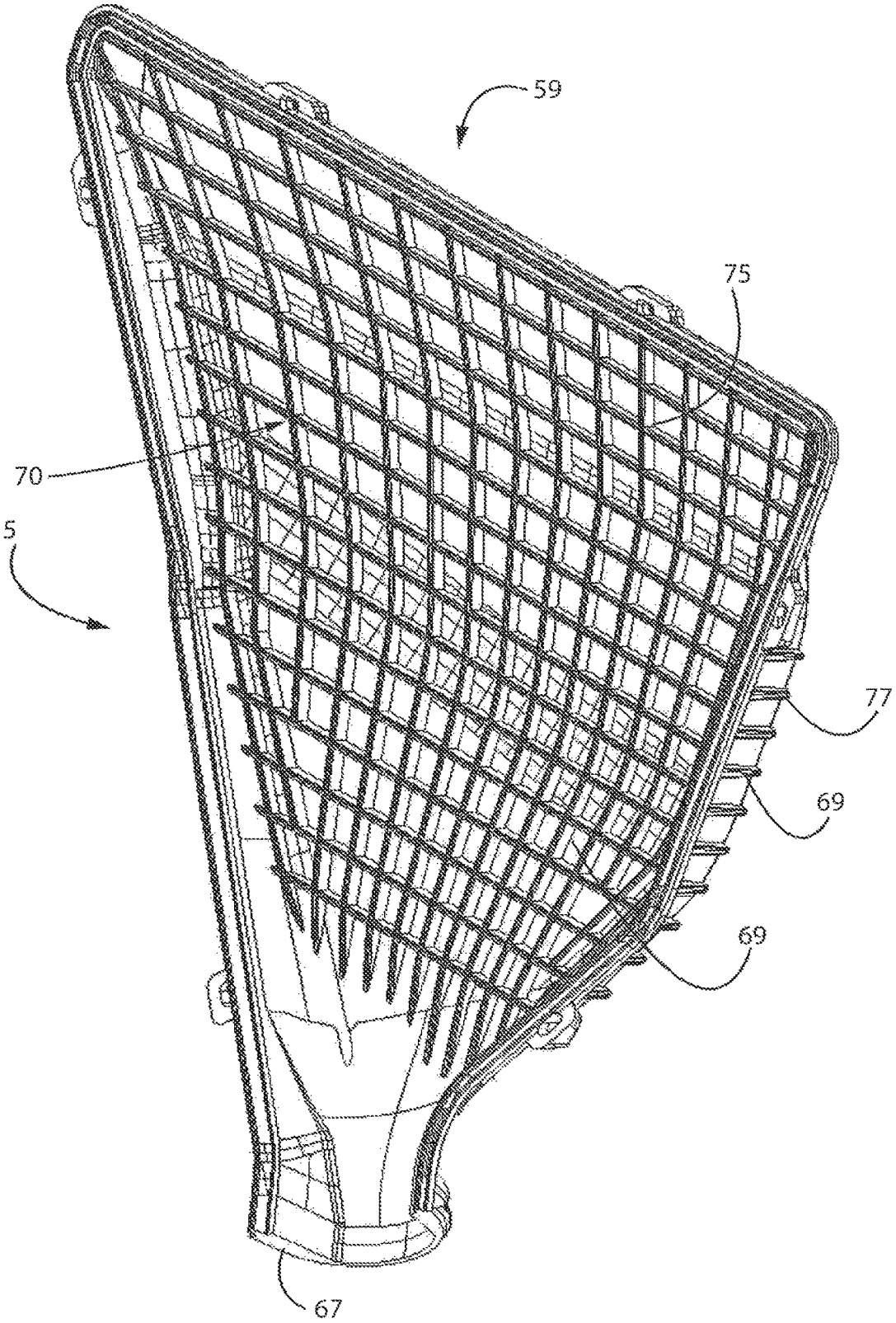
FIG. 10 is a perspective view of the top half shell of the top air plenum.

FIG. 10 shows the interior side 75 of the top half shell 59 of the top air plenum 5. The grid 69 is shown to encompass nearly the entirety of the interior side 75. A plurality of raised shapes 70 such as circles or polygons 72 are shown that make up the grid 69. The interior side of both the top half shell 59 and the bottom half shell 61 of both the top air plenum 5 and the bottom air plenum 7 may also include a similar grid 69 that covers an entirety of the respective plenum's surface.

Figure 11:
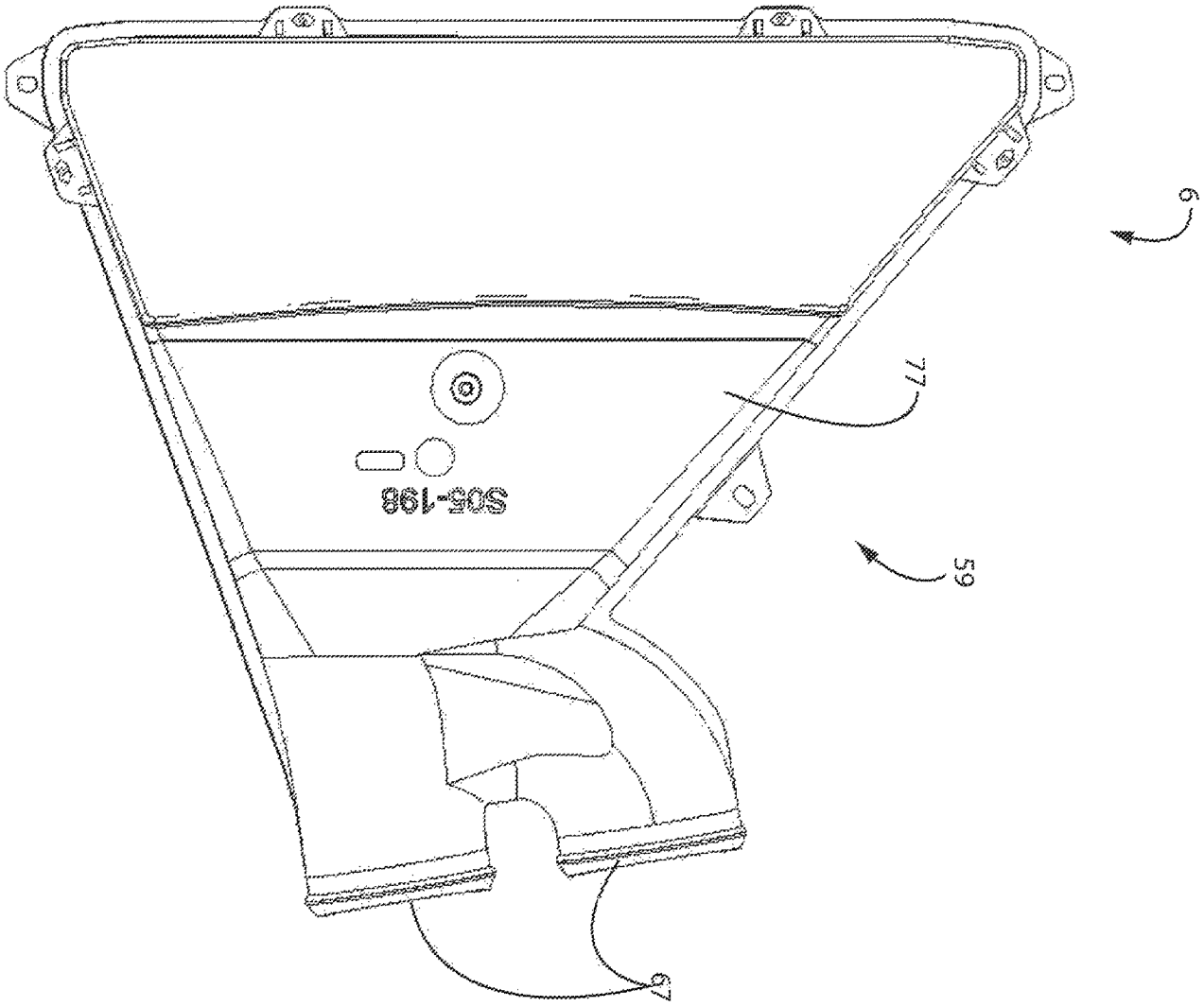
FIG. 11 is a top view of the top half shell plenum of the distribution air plenum according to one embodiment of the present invention.

FIG. 11 discloses an alternative embodiment including a distribution air plenum 6. The exterior side 77 of the top half shell 59 of the distribution air plenum 6 is shown without a grid 69; however, it may include a grid 69 on either of the interior side 75, the exterior side 77, or both the interior and exterior sides 75, 77. Likewise, the grid 69 may be included on the interior side 75, the exterior side 77, or both the interior and exterior sides of the top air plenum 5 and the bottom air plenum 7.

Figure 12:
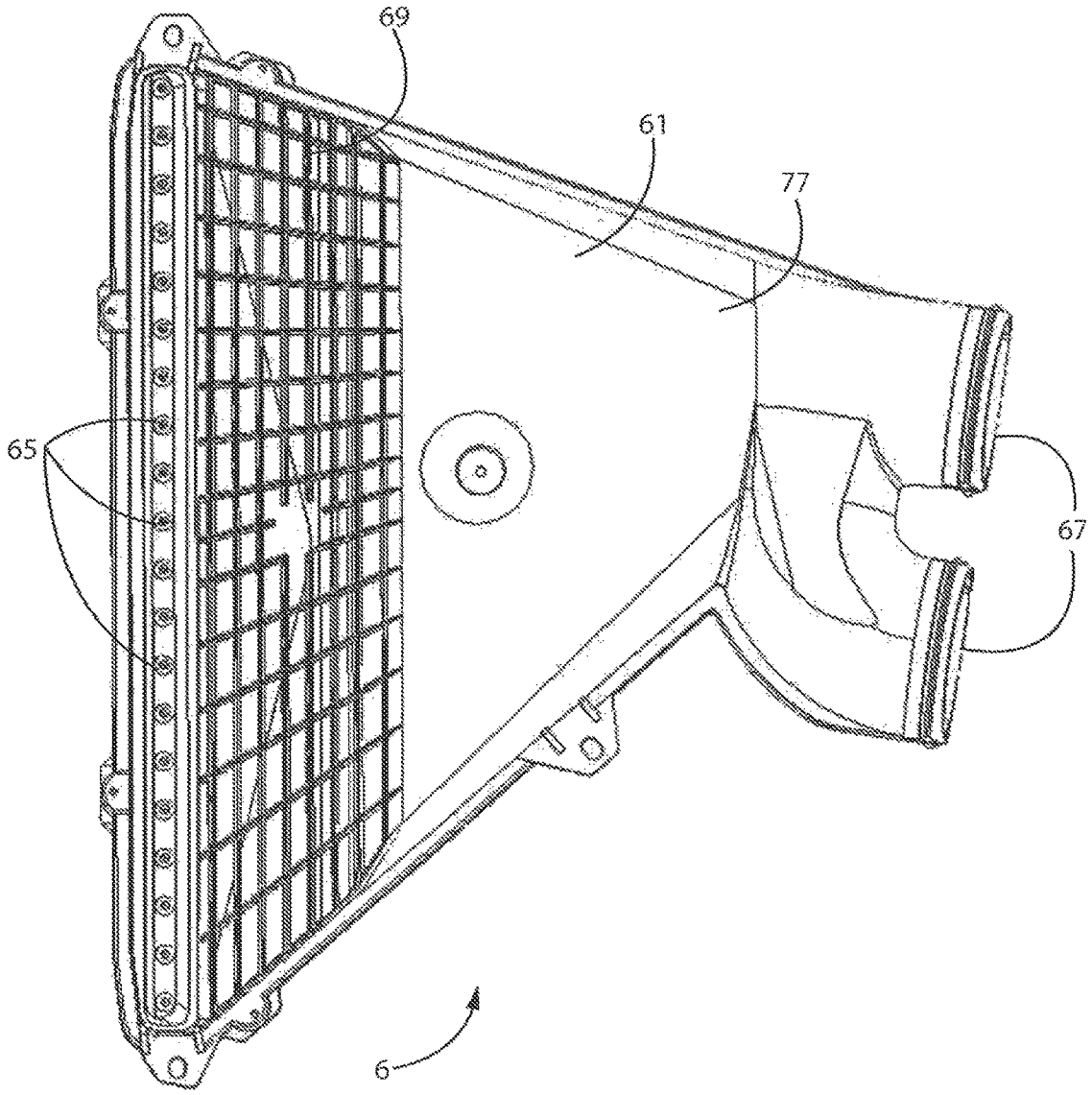
FIG. 12 is a bottom view of the bottom half shell of the distribution air plenum according to one embodiment of the present invention.

The exterior side 77 of the bottom half shell 61 of the distribution air plenum 6 is shown in FIG. 12. The grid 69 is shown alongside the air outlets 65. Dual air inlets 67 allow for an alternate means of preventing water which enters the bottom air plenum 7 from communicating to the blower 11. In lieu of dual air inlets 67, the same "inverted p-trap" concept can be accomplished using a T-type junction offering a plurality of air inlets and outlets, and which fluidly communicates with the blower 11, top air plenum 5 and bottom air plenum 7. Such a configuration may also optimize air distribution throughout the distribution air plenum 6 and to the air outlets 65. The distribution air plenum 6 may be used as either a top air plenum 5 or a bottom air plenum 7 depending on the desired airflow required.

Figure 13:
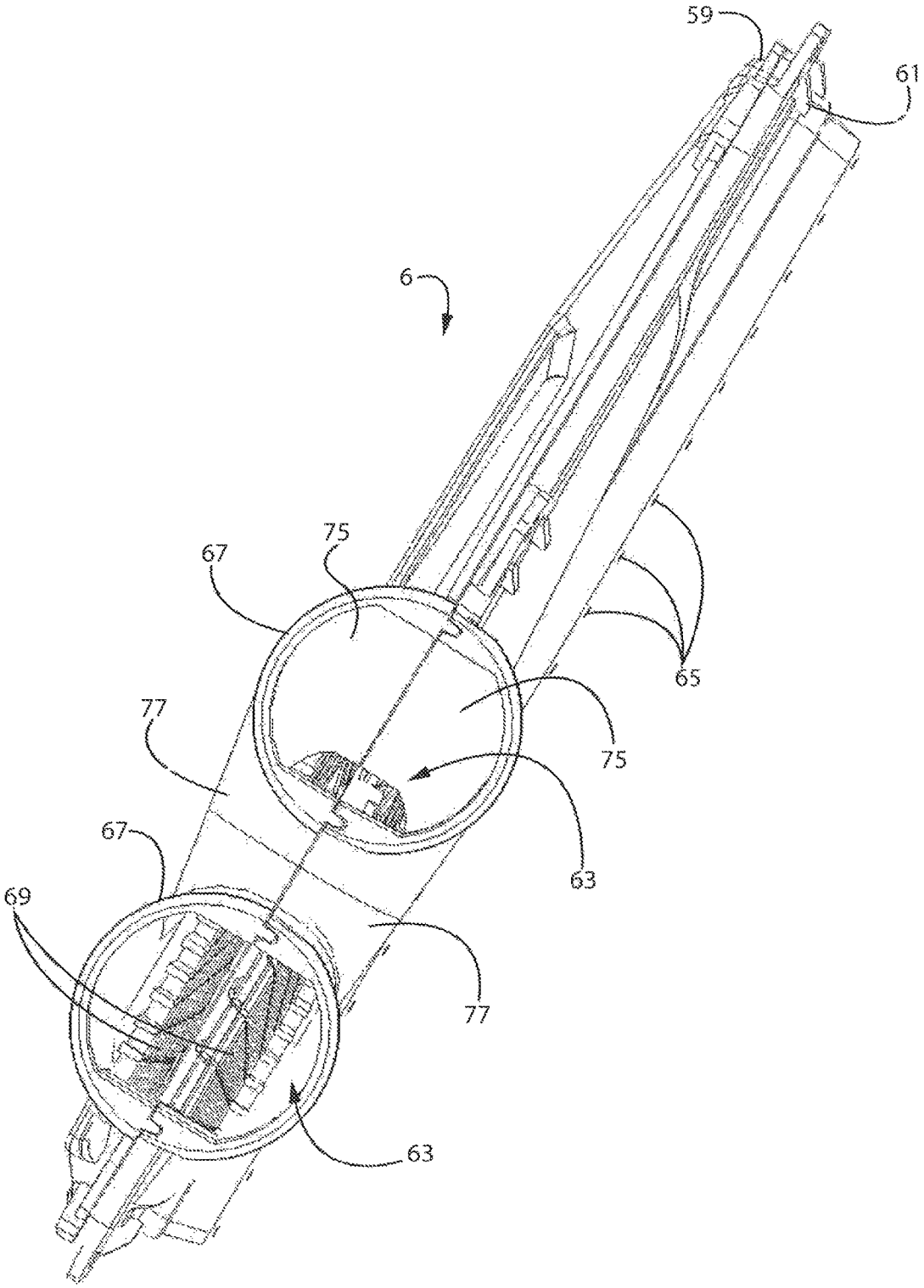
FIG. 13 is a side view of the distribution air plenum showing the interior space according to one embodiment of the present invention.

FIG. 13 shows a side view of the distribution air plenum 6. The top half shell 59 is joined to the bottom half shell 61 and completes the air inlets 67. Also, an interior space 63 is formed within the distribution air plenum 6. A grid 69 may be seen formed into the interior side 75 of both the top half shell 59 and the bottom half shell 61. While the interior space 63 is only shown for the distribution air plenum 6, both the top air plenum 5 and the bottom air plenum 7 may include a similar interior space 63 with similar grids 69. The air outlets 65 are also seen on the exterior side 77 of the bottom half shell 61.

Figure 14:
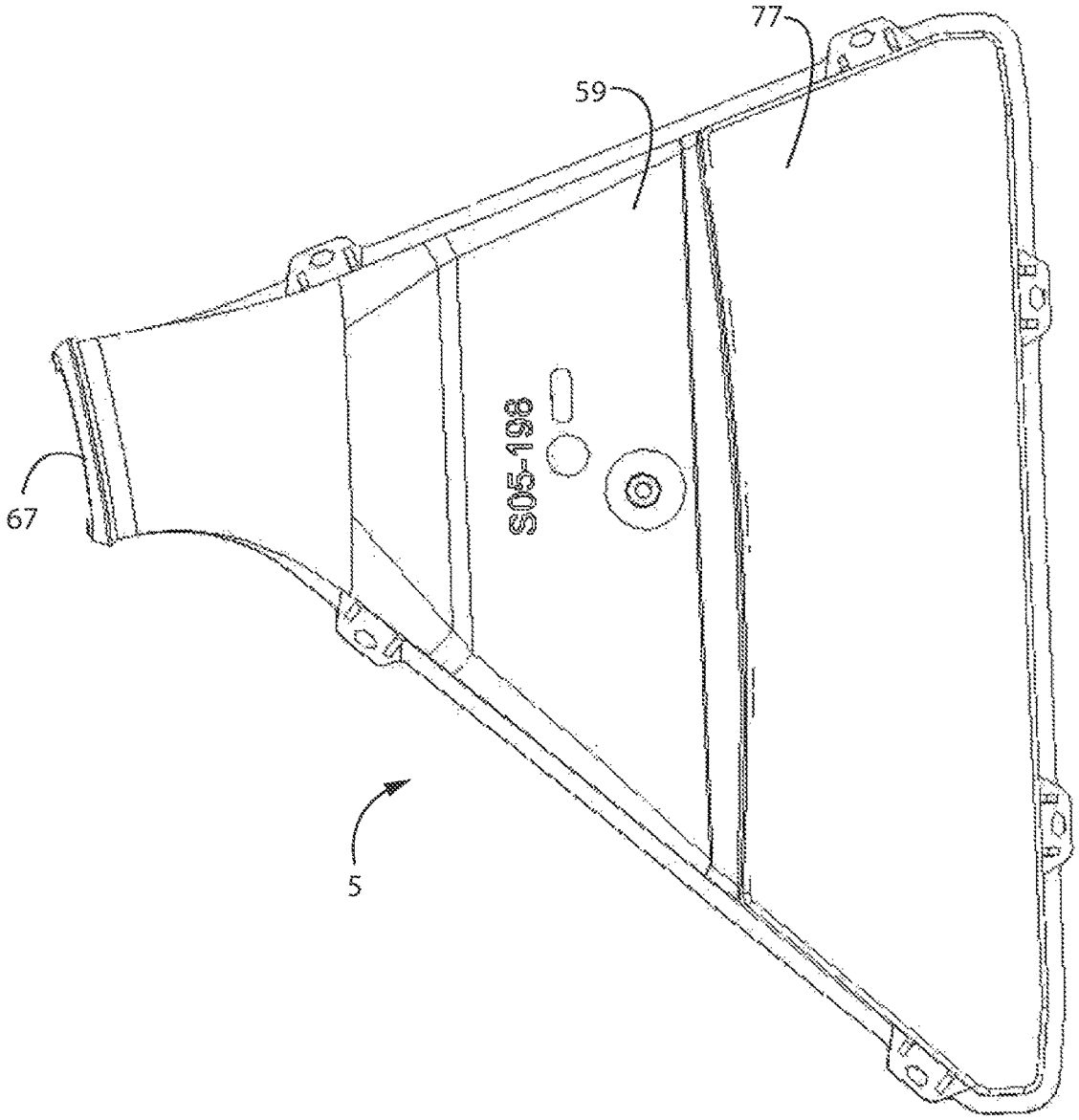
FIG. 14 is a top view of the top half shell of the top air plenum according to one embodiment of the present invention.

FIG. 14 shows the exterior side 77 of the top half shell 59 of the top air plenum 5. Again, while a grid 69 is not shown on the exterior side 77, it may be included. The air inlet 67 allows for attachment of the first air hose 71, as shown in FIG. 7.

Figure 15:
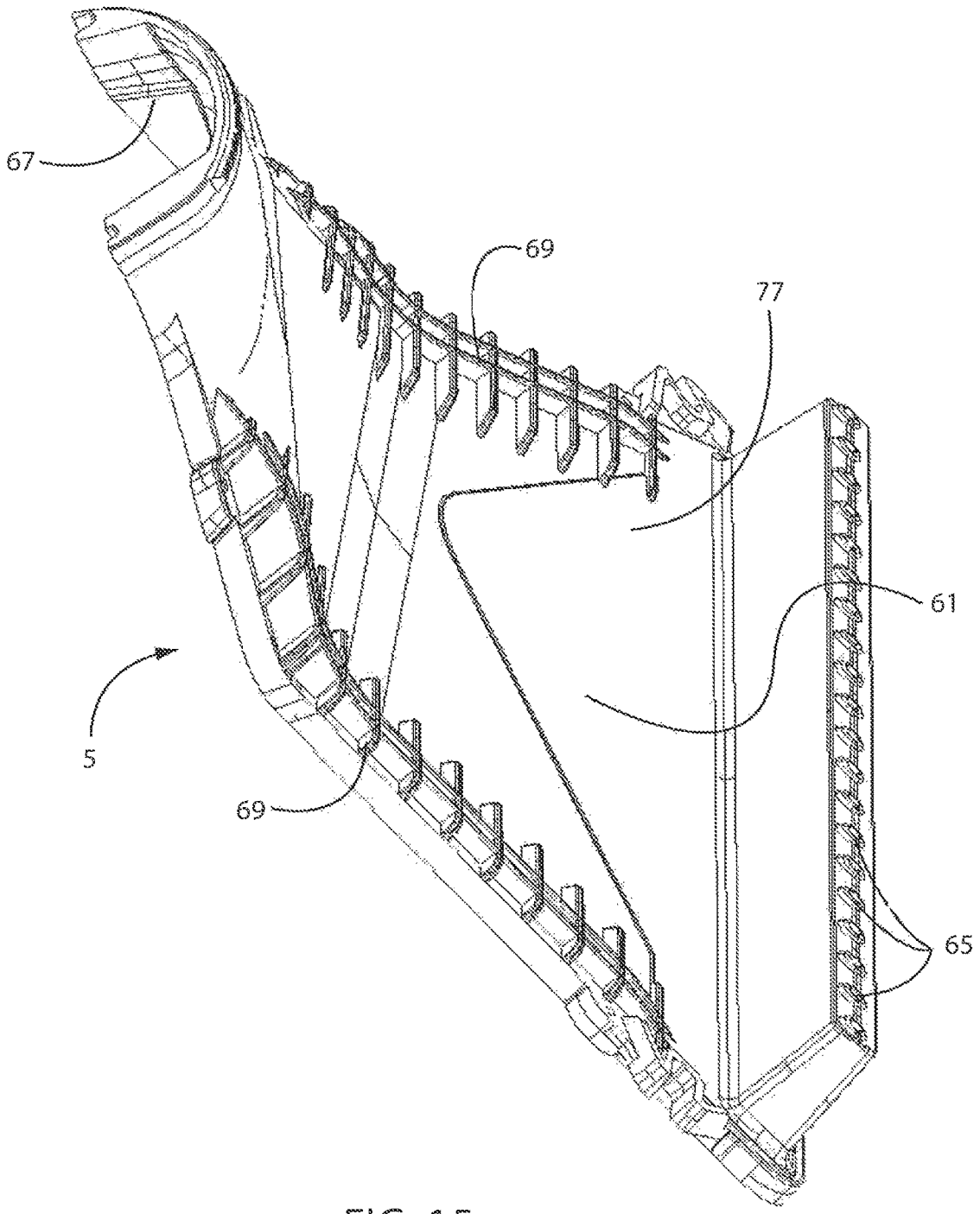
FIG. 15 is a perspective view of the bottom half shell of the top air plenum according to one embodiment of the present invention.

FIG. 15 shows the exterior side 77 of the bottom half shell 61 of the top air plenum 5. Grids 69 are shown along the edges of the bottom half shell 61. The air inlet 67 allows for attachment of the first air hose 71 to supply air to the air outlets 65, as seen in FIG. 7.

Figure 16:
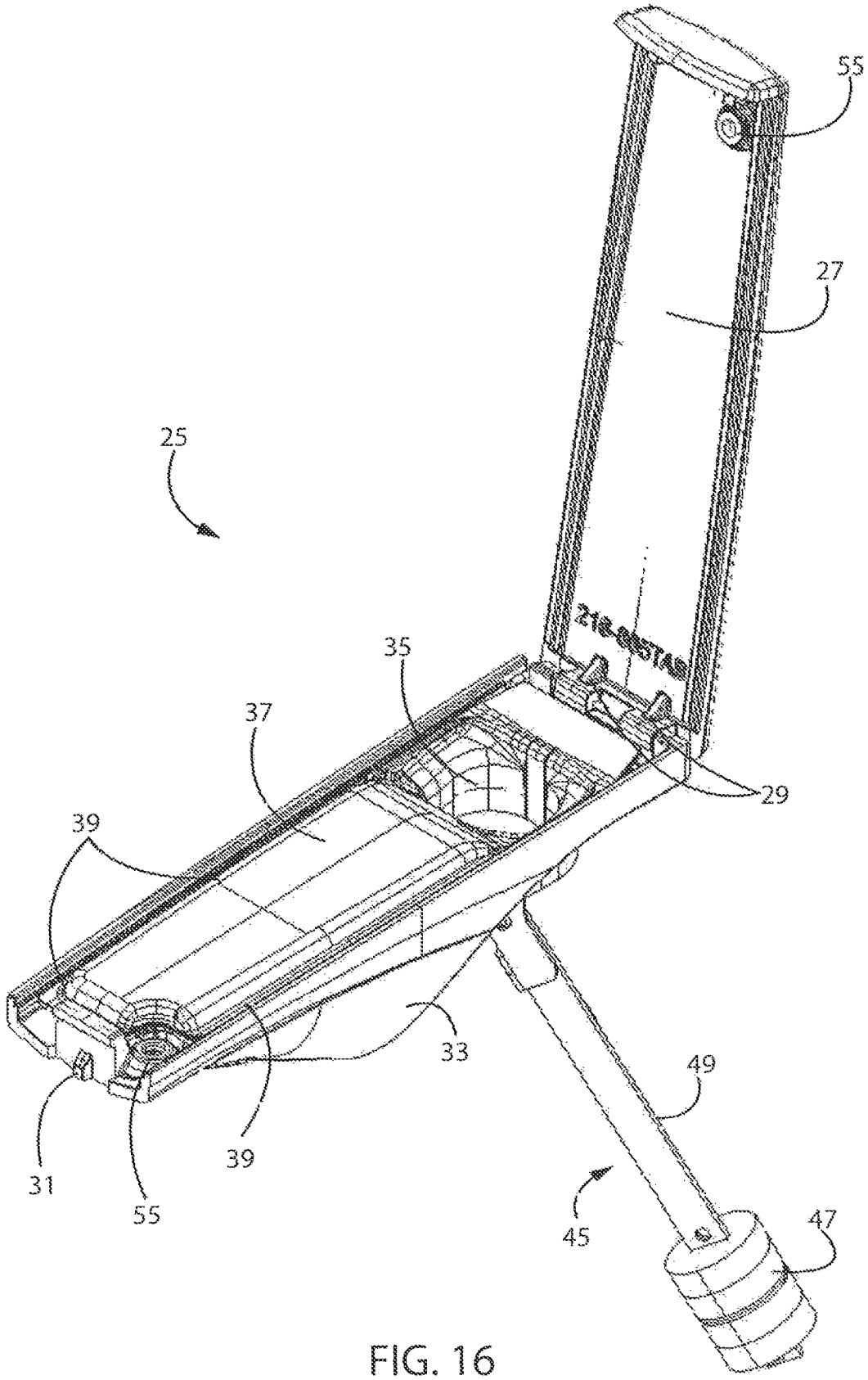
FIG. 16 is a perspective view of the soap dispenser according to the present invention.
Figure 20:
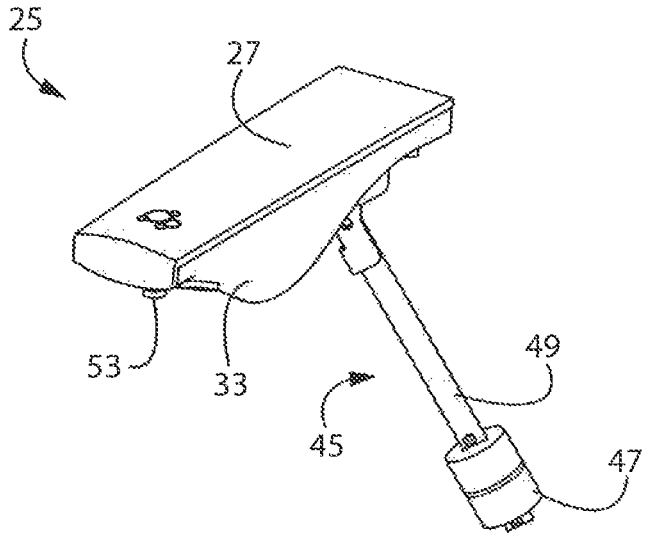
FIG. 20 is a partially exploded perspective view of the soap dispenser, the reservoir and the soap pump according to the present invention.
Figure 20:
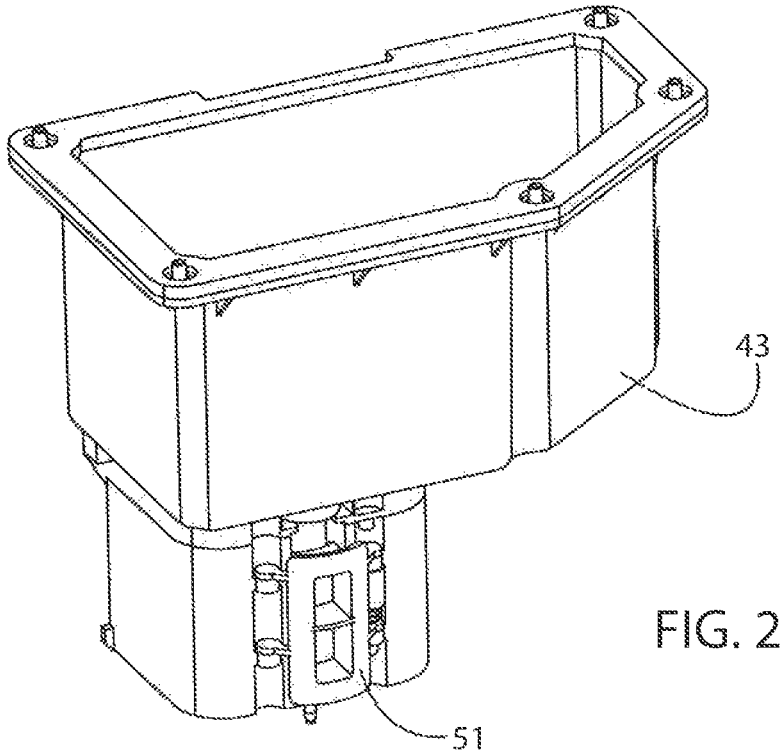

Turning now to FIG. 16, the soap dispenser 25 is shown with a lid 27 in the open position. A clasp 31 located second end 36 on the base 33 and secures the lid 27 to the base 33. A hinge is also located on the first end 34 of the base as well as on the first end 28 of the lid. When the lid is pivoted about the hinge 29, the second end 30 of the lid 27 may be joined with the base 33 and secured by the clasp 31. A provision is made adjacent to the clasp for a fastener (not shown) to hold the lid closed for added security and tampering prevention, e.g., a hole 55. A funnel insert 37 is inserted into the base 33 and includes a channel 39 around the perimeter of the funnel insert 37 and a fill port 35. The channel 39 and the fill port 35 funnel fluid such as liquid soap that may be poured into the soap dispenser 25. The liquid soap flows through the channel 39 and through the fill port 35 into a reservoir 43, as shown in FIG. 20. A level sensor 45 senses a level of liquid soap in the reservoir 43. The level sensor 45 includes a float 47 attached to a rod 49. The float 47 may slide along the rod 49 indicating the level of soap in the reservoir 43, or, the float 47 may be attached to the distal end of the rod 49 allowing the rod 49 to pivot about the base 33 similar to a float in a traditional toilet water tank. The level sensor 45 may interact with electronics to light up an indicator light on the base 33 and also on the lid 27 indicating the sensed level of soap in the reservoir 43.

Figure 17:
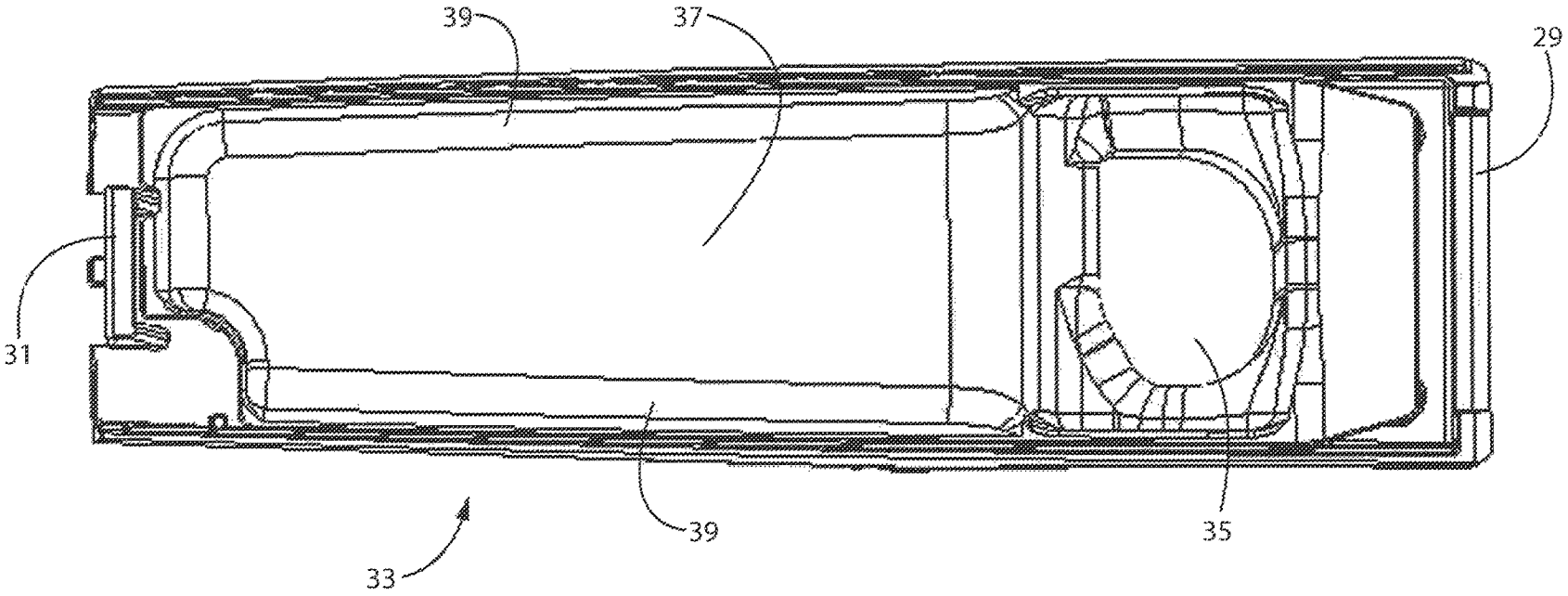
FIG. 17 is a top view of the base and funnel insert according to the present invention.

FIG. 17 shows a top view of the base 33. The channel 39 is seen along the perimeter of the funnel insert 37 leading poured fluid to the fill port 35. The hinge 29 and clasp 31 allow attachment of the lid 27, as described above.

Figure 18:
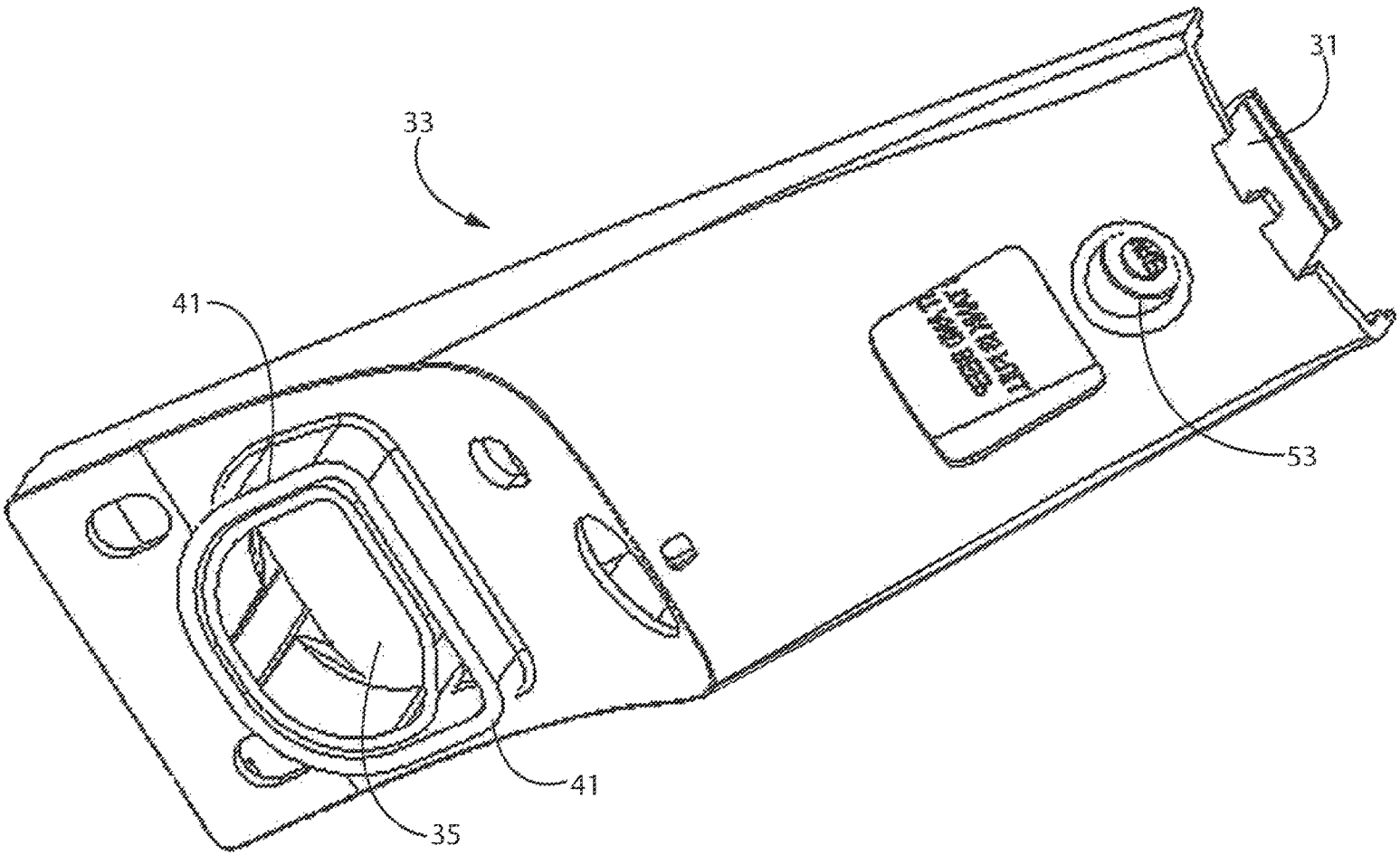
FIG. 18 is a bottom side perspective view of the base of the soap dispenser according to the present invention.

FIG. 18 shows the bottom side of the base 33. The fill port 35 is shown as well as a surrounding reservoir mount 41 that allows attachment of the reservoir 43 shown in FIG. 20. The soap outlet 53 dispenses soap from the base 33 when the soap pump 51, also seen in FIG. 20, is activated. The clasp 31 secures the lid 27 as seen in FIG. 16.

Figure 19:
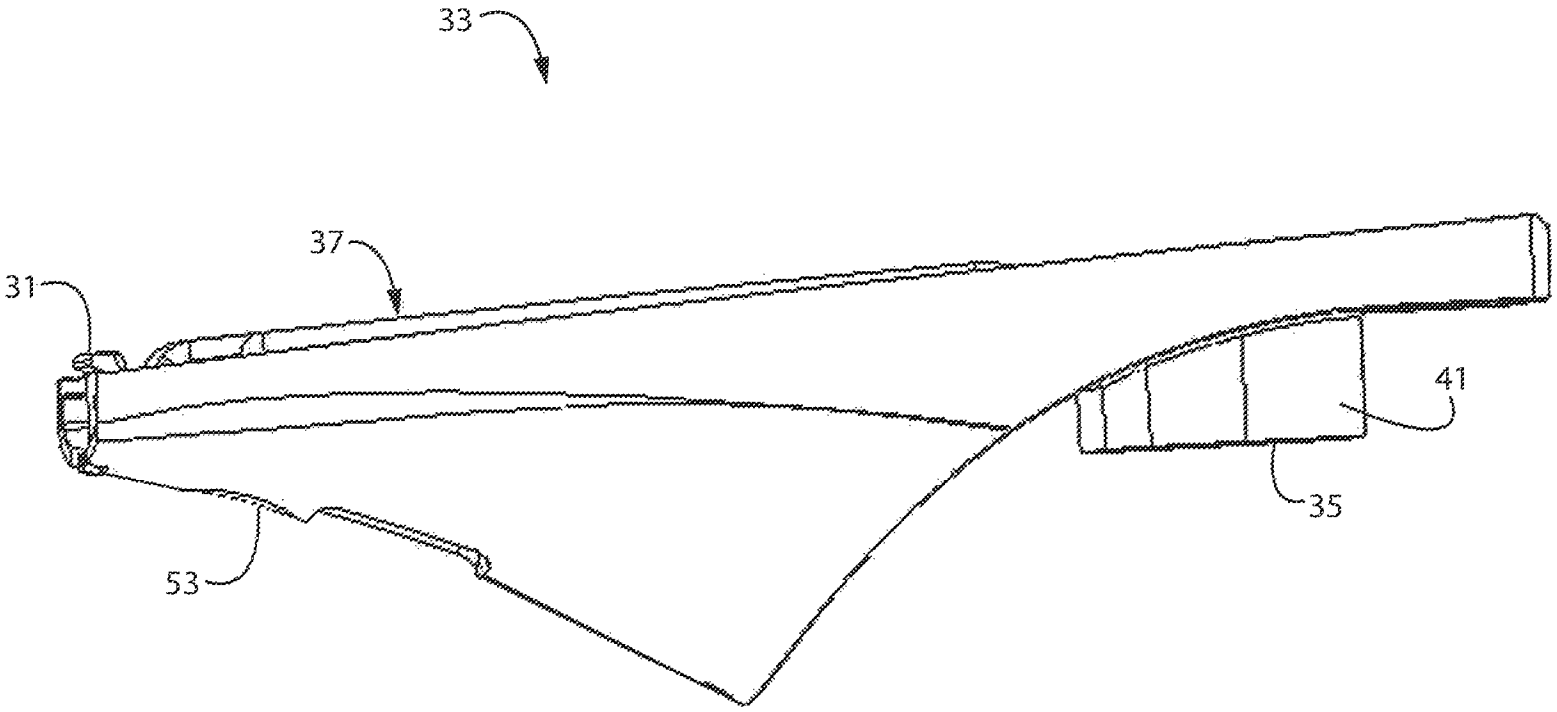
FIG. 19 is side view of the base and funnel insert according to the present invention.

A side view of the base 33 of the soap dispenser 25 is shown in FIG. 19. The reservoir mount 41 surrounds the fill port 35. The funnel insert 37 and the clasp 31 may be seen projecting above the edge of the base 33 while the soap outlet 53 may be seen on the bottom portion of the base 33.

Transitioning to FIG. 20, the soap dispenser 25 is shown in complete form including the lid 27 attached to the base 33, the level sensor 45 with the rod 49, the float 47, and the soap outlet 53. The reservoir 43 contains the liquid soap that is poured through the fill port 35. The reservoir 43 is attached to the underside of the basin 1, as partially seen in FIG. 5. The soap pump 51 is user activated to pump the stored liquid soap to the soap outlet 53.

Figure 21:
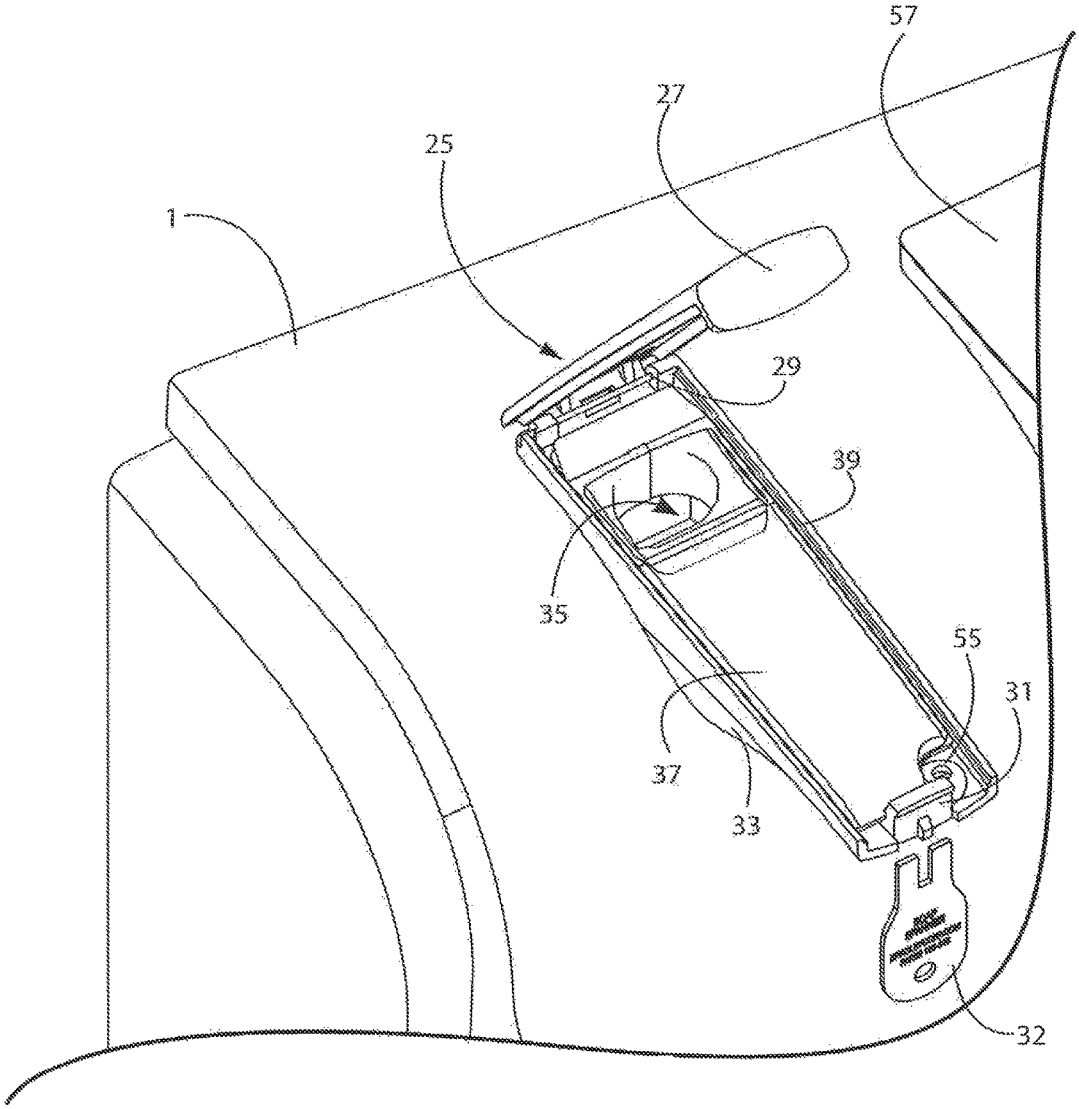
FIG. 21 is a perspective view of the soap dispenser mounted on the basin of the multi-purpose hand washing station according to the present invention.

FIG. 21 shows the base 33 of the soap dispenser 25 mounted to the top side 16 of the basin 1. The faucet 57 may also be seen attached to the basin 1 alongside the soap dispenser 25. The lid 27 is pivoted about the hinge 29 and in the open position exposing the fill port 35, the channel 39, the indicator light and the funnel insert 37. In order to release the clasp 31 and allow the lid 27 to rotate open from the base 33, a clasp key 32 may be used. The clasp key 32 may be provided to a maintenance person in order to prevent an unauthorized user from tampering with the soap dispense 25.

Although a best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. For example, one preferred embodiment provides for the use of liquefied soap. However, as can be appreciated, any hand cleaner may be used, e.g., a foam soap, hand sanitizer, gel, or other type of cleaner may be provided.

Further, in one embodiment, a level sensor that extends downwardly from the reservoir mount includes a float directly attached to a rod, e.g., the float is attached to the distal end of the rod allowing the rod to pivot about the base. There the float is buoyed in the liquid soap allowing the level sensor to sense the level of liquid soap in a reservoir that is attached to the reservoir mount. In another embodiment, the level sensor includes a float slidingly engaged to a rod and submergable in the fluid within the reservoir to sense a level of fluid within the reservoir.

In one embodiment, the plenums may be mounted side-to-side plenums, for example, for a horizontal air flow. Here, the user may put one hand on top of the other to have the water wicked from the hands. A third plenum may be added to this configuration to make the flow of air on the user's hand more uniform.

It should also be noted that the blower motor may have brushes or may be brushless. Further, in one embodiment, the blower housing for the brushless motor only has one air outlet and not a plurality of outlets as otherwise disclosed herein.

In addition, the individual components called out herein need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Further, although the components described herein are often described as physically separate modules, it will be manifest that they may be integrated into the apparatus with which it is associated. Finally, all the disclosed features of each disclosed embodiment can be combined with, or substituted for, the disclosed features of every other disclosed embodiment except where such features are mutually exclusive.

As can be seen, it is specifically intended that the present invention not be limited to the embodiments and illustrations contained herein, but includes modified forms of those embodiments including portions of the embodiments and combinations of elements of different embodiments as come within the scope of the following claims.

We claim:

1. A multi-purpose hand washing station comprising;

a basin attached to a wall by a support structure;

a top air plenum hood attached to the basin;

a top air plenum attached within the top air plenum hood and suspended over the basin;

at least one air inlet included in the top air plenum;

an air outlet included in the top air plenum;

a bottom air plenum attached to a bottom side of the basin and mounted directly below the top air plenum;

at least one air inlet included in the bottom air plenum;

an air outlet extending from a top side of the basin included in the bottom air plenum;

a blower mounted below the basin and configured to supply an air pressure to the top air plenum and the bottom air plenum;

a first air hose with a first and a second end, the first end connected to at least one air inlet of the top air plenum and the second end connected to the blower;

a second air hose with a first and second end, the first end connected to at least one air inlet of the bottom air plenum, the second hose including a vertical length extending from the at least one air inlet of the bottom air plenum in an upward vertical direction, and a bend extending the second hose in a downward vertical direction and attaching the second end of the second air hose to the blower; and a fastener attaching the bend to the top air plenum hood and configured to locate the bend within the top plenum hood.

2. The multi-purpose hand washing station of claim 1 further comprising at least one grid formed of a plurality of raised ribs molded into each one of the top air plenum and bottom air plenum, the at least one grid configured to provide structural support to an interior space of the top and bottom air plenum when an air pressure is supplied to the interior space by the first and second air hose.

3. The multi-purpose hand washing station of claim 1 wherein the basin and the support structure are attached to a soap dispenser and a faucet.

4. The multi-purpose hand washing station of claim 1 wherein the plurality of air outlets of the top air plenum and the bottom air plenum are oriented to generally point toward one another.

5. The multi-purpose hand washing station of claim 1 wherein the first air hose and the second air hose comprise any one of a rigid tubing, a molded tubing, a flexible tubing, and a corrugated tubing, rubber tubing, vinyl tubing, silicone tubing, plastic tubing, or hard molded tubing.

6. The multi-purpose hand washing station of claim 1 wherein the top air plenum hood comprises a top air plenum hood top half attached to a top air plenum hood bottom half with a plurality of screws.

7. The multi-purpose hand washing station of claim 1 further comprising: a plurality of air outlets and an air inlet on the blower, wherein the second ends of the first and second air hose attach to the plurality of air outlets of the blower with fasteners.

8. The multi-purpose hand washing station of claim 6 wherein an interior space is formed by the top air plenum hood top half engaging with the top air plenum hood bottom half; and wherein the top air plenum hood further comprises at least one grid formed of a plurality of raised shapes molded into at least one side of either the top air plenum hood top half and the top air plenum hood bottom half, the at least one grid configured to provide structural support when an air pressure is supplied to an interior space by the air.

9. The multi-purpose hand washing station of claim 8 wherein the plurality of raised shapes forming the grid includes polygons.

10. The multi-purpose hand washing station of claim 8 wherein the at least one grid includes a grid on an exterior side of the top air plenum hood top half and a grid on an exterior side of the top air plenum hood bottom half.

11. The multi-purpose hand washing station of claim 8 wherein the at least one grid includes a grid on an interior side of the top air plenum hood top half and a grid on an interior side of the top air plenum hood bottom half.

12. The multi-purpose hand washing station of claim 8 wherein the at least one grid includes a grid on an interior side of the top air plenum hood top half, a grid on an exterior side of the top air plenum hood top half, a grid on an interior side of the top air plenum hood bottom half, and a grid on an exterior side of the top air plenum hood bottom half.

* * * * *